US009383720B1

(12) United States Patent
Fukamachi et al.

(10) Patent No.: US 9,383,720 B1
(45) Date of Patent: Jul. 5, 2016

(54) PROCESS CARTRIDGE AND DRUM CARTRIDGE

(71) Applicant: Brother Kogyo Kabushiki Kaisha, Nagoya-shi, Aichi-ken (JP)

(72) Inventors: Yasuo Fukamachi, Nagoya (JP); Kazuna Taguchi, Nagoya (JP); Koji Abe, Nagoya (JP); Takuya Kanda, Nagoya (JP); Motoaki Mushika, Hashima (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/845,380

(22) Filed: Sep. 4, 2015

(30) Foreign Application Priority Data

Feb. 6, 2015 (JP) ..... 2015-022607

(51) Int. Cl.
*G03G 21/18* (2006.01)

(52) U.S. Cl.
CPC ..... *G03G 21/1814* (2013.01)

(58) Field of Classification Search
USPC ..... 399/107, 110, 111, 113
See application file for complete search history.

(56) References Cited

U.S. PATENT DOCUMENTS 5,745,824 A * 4/1998 Yashiro ..... G03G 21/181 399/113
6,101,350 A * 8/2000 Suzuki ..... G03G 15/0896 399/111
7,742,720 B2 * 6/2010 Okabe ..... G03G 21/1814 399/111

FOREIGN PATENT DOCUMENTS

JP 2011-197197 A 10/2011

* cited by examiner

*Primary Examiner* — Hoan Tran
(74) *Attorney, Agent, or Firm* — Banner & Witcoff, Ltd.

(57) ABSTRACT

A process cartridge includes a drum cartridge and a developing cartridge attachable to and detachable from the drum cartridge. The developing cartridge includes a developing roller, a pressing protrusion and an engagement protrusion. The drum cartridge includes a photosensitive drum, a locking member engageable with the engagement protrusion of the developing cartridge attached to the drum cartridge, and a pressing member disposed between the locking member and the photosensitive drum. The locking member is pivotable between a restricting position engaged with the engagement protrusion to restrict detachment of the developing cartridge from the drum cartridge and a non-restricting position disengaged from the engagement protrusion to allow detachment of the developing cartridge from the drum cartridge. The pressing member is configured to contact the pressing protrusion of the developing cartridge attached to the drum cartridge for pressing the developing cartridge toward the photosensitive drum.

27 Claims, 16 Drawing Sheets

PROCESS CARTRIDGE AND DRUM CARTRIDGE

CROSS REFERENCE TO RELATED APPLICATION

This application claims priority from Japanese Patent Application No. 2015-022607 filed Feb. 6, 2015. The entire content of the priority application is incorporated herein by reference.

TECHNICAL FIELD

The present disclosure relates to a process cartridge and a drum cartridge mountable in an electro-photographic image forming apparatus.

BACKGROUND

As a process cartridge mountable in an electro-photographic image forming apparatus, there has been proposed a process cartridge that includes a photosensitive cartridge and a developing cartridge attachable to the photosensitive cartridge. The photosensitive cartridge includes a photosensitive drum, and the developing cartridge includes a developing roller (for example, see Japanese Patent Application Publication No. 2011-197197).

SUMMARY

In this process cartridge, the photosensitive cartridge includes a pressing portion, and the developing cartridge includes a pressed portion configured to be pressed by the pressing portion. Pressing the pressed portion by the pressing portion causes the developing roller to be pressed against the photosensitive drum.

In an effort to increase an amount of toner stored in the developing cartridge, the developing cartridge may be made larger in size in a direction away from the photosensitive drum, without providing a wall bridging between left and right side walls supporting the photosensitive drum on one end of the photosensitive cartridge remote from the photosensitive drum.

However, if the wall bridging the right and left side walls were not provided, degradation in rigidity of the photosensitive cartridge would be expected.

Further, in this case, if the pressing portion is positioned excessively far away from the photosensitive drum, a reaction force generated by the pressing portion pressing the pressed portion may cause deformation of the photosensitive cartridge. Such deformation of the photosensitive cartridge would make it difficult to appropriately press the developing roller against the photosensitive drum.

In view of the foregoing, it is an object of the disclosure to provide a process cartridge and a drum cartridge capable of stably pressing a developing roller against a photosensitive drum even if an amount of stored developer is increased.

In order to attain the above and other objects, the disclosure provides a process cartridge including a drum cartridge and a developing cartridge attachable to and detachable from the drum cartridge. The developing cartridge includes a developing roller, a pressing protrusion and an engagement protrusion. The drum cartridge includes a photosensitive drum, a locking member engageable with the engagement protrusion of the developing cartridge attached to the drum cartridge, and a pressing member disposed between the locking member and the photosensitive drum. The locking member is pivotable between a restricting position engaged with the engagement protrusion to restrict detachment of the developing cartridge from the drum cartridge and a non-restricting position disengaged from the engagement protrusion to allow detachment of the developing cartridge from the drum cartridge. The pressing member is configured to contact the pressing protrusion of the developing cartridge attached to the drum cartridge for pressing the developing cartridge toward the photosensitive drum.

According to another aspect, the disclosure provides a drum cartridge to which a developing cartridge including a developing roller is detachably attachable. The drum cartridge includes a photosensitive drum, a locking member and a pressing member disposed between the locking member and the photosensitive drum. The locking member is configured to pivot between a restricting position engaged with the developing cartridge to restrict detachment of the developing cartridge and a non-restricting position disengaged from the developing cartridge to allow detachment of the developing cartridge. The pressing member is configured to press the developing roller toward the photosensitive drum when the developing cartridge is attached to the drum cartridge.

According to still another aspect, the disclosure provides a drum cartridge including a photosensitive drum, a pivotally movable locking lever and a spring disposed between the locking member and the photosensitive drum. The locking lever includes a shaft having a peripheral surface, and an operation arm extending from the peripheral surface of the shaft. The operation arm includes a base and a claw extending from the base toward the photosensitive drum.

BRIEF DESCRIPTION OF THE DRAWINGS

The particular features and advantages of the disclosure as well as other objects will become apparent from the following description taken in connection with the accompanying drawings, in which.

DETAILED DESCRIPTION

1. Overall Structure of Process Cartridge

A process cartridge 1 according to an embodiment will be described first while referring to FIGS. 1 through 16.

In the following description, directions in relation to the process cartridge 1 will be based on a state where the process cartridge 1 is resting on a horizontal plane. Thus up-down direction of the process cartridge 1 corresponds to the vertical direction. Specifically, directions of the process cartridge 1 are indicated by arrows shown in FIG. 1.

Figure 1:
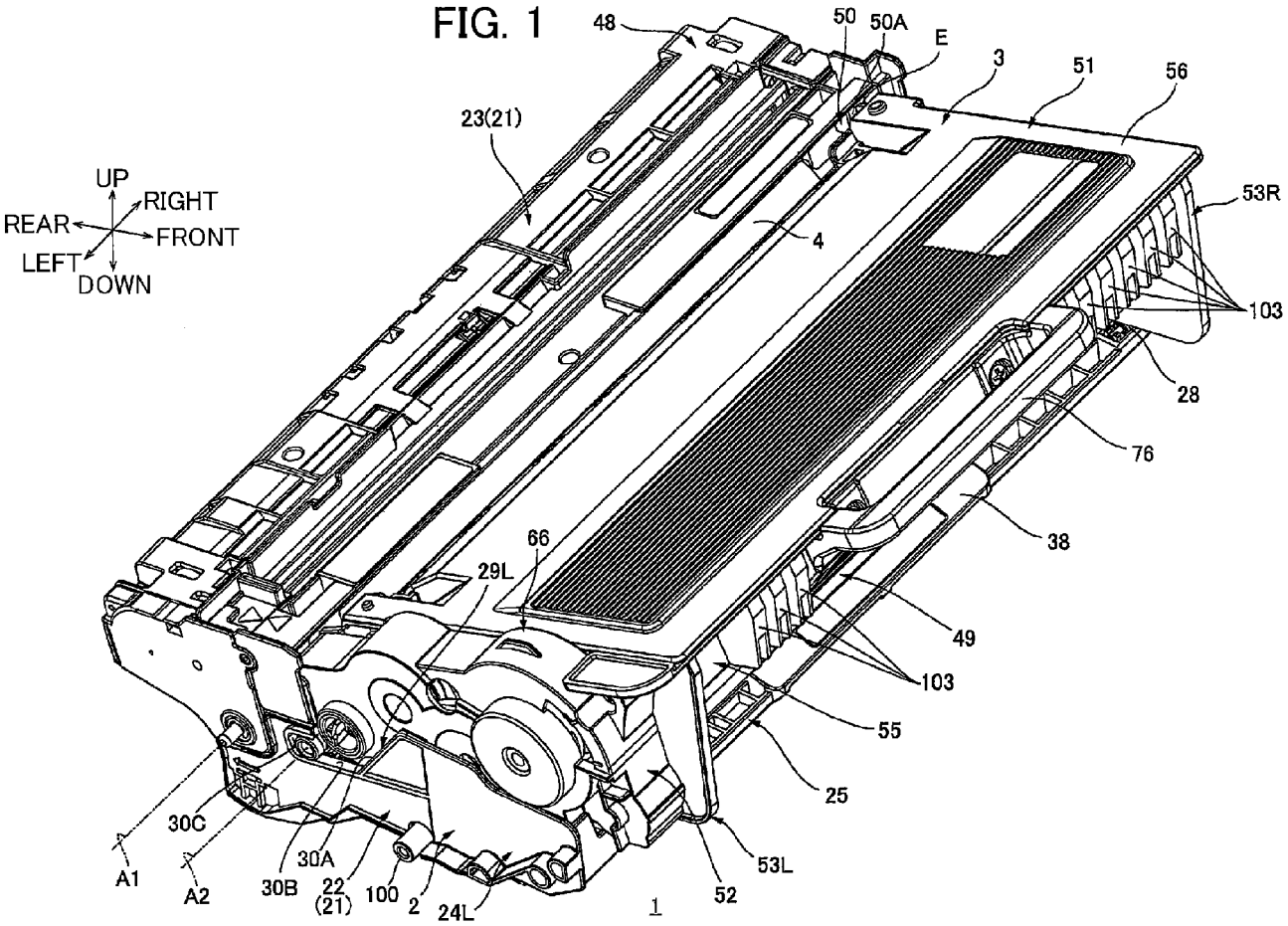
FIG. 1 is a perspective view showing a general construction of a process cartridge according to an embodiment as viewed from an upper-front perspective, the process cartridge including a drum cartridge and a developing cartridge.
Figure 16:
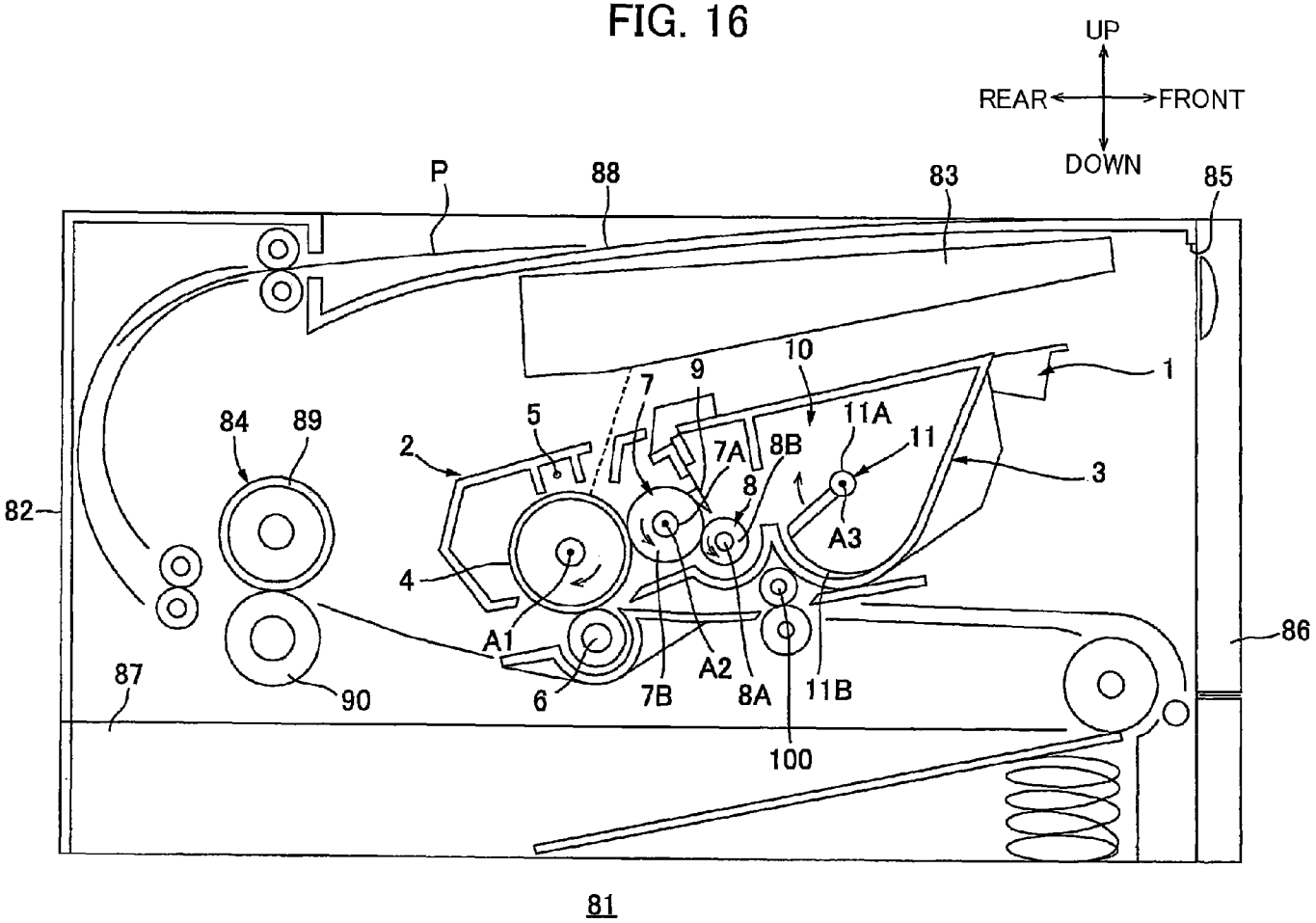
FIG. 16 is a schematic vertical cross-sectional view of an image forming apparatus in which the process cartridge according to the embodiment is mounted.

As illustrated in FIGS. 1 and 16, the process cartridge 1 includes a drum cartridge 2 and a developing cartridge 3.

The drum cartridge 2 includes a photosensitive drum 4, a scorotron charger 5, and a transfer roller 6.

The photosensitive drum 4 is rotatably supported by a rear end portion of the drum cartridge 2. The photosensitive drum 4 has a cylindrical shape that extends in a left-right direction. The photosensitive drum 4 defines a rotation axis A1 extending in the left-right direction.

The scorotron charger 5 is arranged rearward and upward of the photosensitive drum 4 and is separated therefrom.

The transfer roller 6 is disposed below the photosensitive drum 4 and is in contact with a lower end portion of the photosensitive drum 4.

The developing cartridge 3 is attachable to and detachable from the drum cartridge 2. When attached to the drum cartridge 2, the developing cartridge 3 is positioned frontward of the photosensitive drum 4. The developing cartridge 3 includes a developing roller 7, a supply roller 8, a thickness regulation blade 9, and a toner storage portion 10.

The developing roller 7 is rotatably supported by a rear end portion of the developing cartridge 3. The developing roller 7 includes a developing-roller shaft 7A and a developing-roller body 7B.

The developing-roller shaft 7A has a columnar shape and extends in the left-right direction. That is, the developing-roller shaft 7A defines a rotation axis A2 extending in the left-right direction. The developing-roller shaft 7A is made of a metal.

The developing-roller body 7B has a cylindrical shape and extends in the left-right direction. The developing-roller body 7B is formed of an electrically conductive rubber. The developing-roller body 7B does not cover both end portions of the developing-roller shaft 7A, but covers a center portion of the developing-roller shaft 7A in the left-right direction. In the process cartridge 1 (when the developing cartridge 3 is attached to the drum cartridge 2), the developing-roller body 7B is in contact with a front end portion of the photosensitive drum 4.

The supply roller 8 is rotatably supported in the developing cartridge 3 at a position frontward and downward of the developing roller 7. The supply roller 8 includes a supply-roller shaft 8A and a supply-roller body 8B.

The supply-roller shaft 8A has a columnar shape and extends in the left-right direction. The supply-roller shaft 8A is formed of a metal.

The supply-roller body 8B has a cylindrical shape. The supply-roller body 8B extends in the left-right direction. The supply-roller body 8B is formed of a sponge having an electrically conductive property. The supply-roller body 8B does not cover both end portions of the supply-roller shaft 8A, but covers a center portion of the supply-roller shaft 8A in the left-right direction. The supply-roller body 8B is in contact with a lower front end portion of the developing-roller body 7B.

The thickness regulation blade 9 is disposed upward and frontward of the developing roller 7. The thickness regulation blade 9 contacts a front end portion of the developing-roller body 7B.

The toner storage portion 10 is disposed forward of the supply roller 8 and the thickness regulation blade 9. The toner storage portion 10 is adapted to store toner. The toner storage portion 10 includes an agitator 11.

The agitator 11 is rotatably supported within the toner storage portion 10. The agitator 11 includes an agitator shaft 11A and a blade 11B.

The agitator shaft 11A has a columnar shape extending in the left-right direction. That is, the agitator shaft 11A defines a rotation axis A3 extending in the left-right direction.

The blade 11B extends radially outward from an outer peripheral surface of the agitator shaft 11A.

2. Detailed Structure of Drum Cartridge

Figure 2:
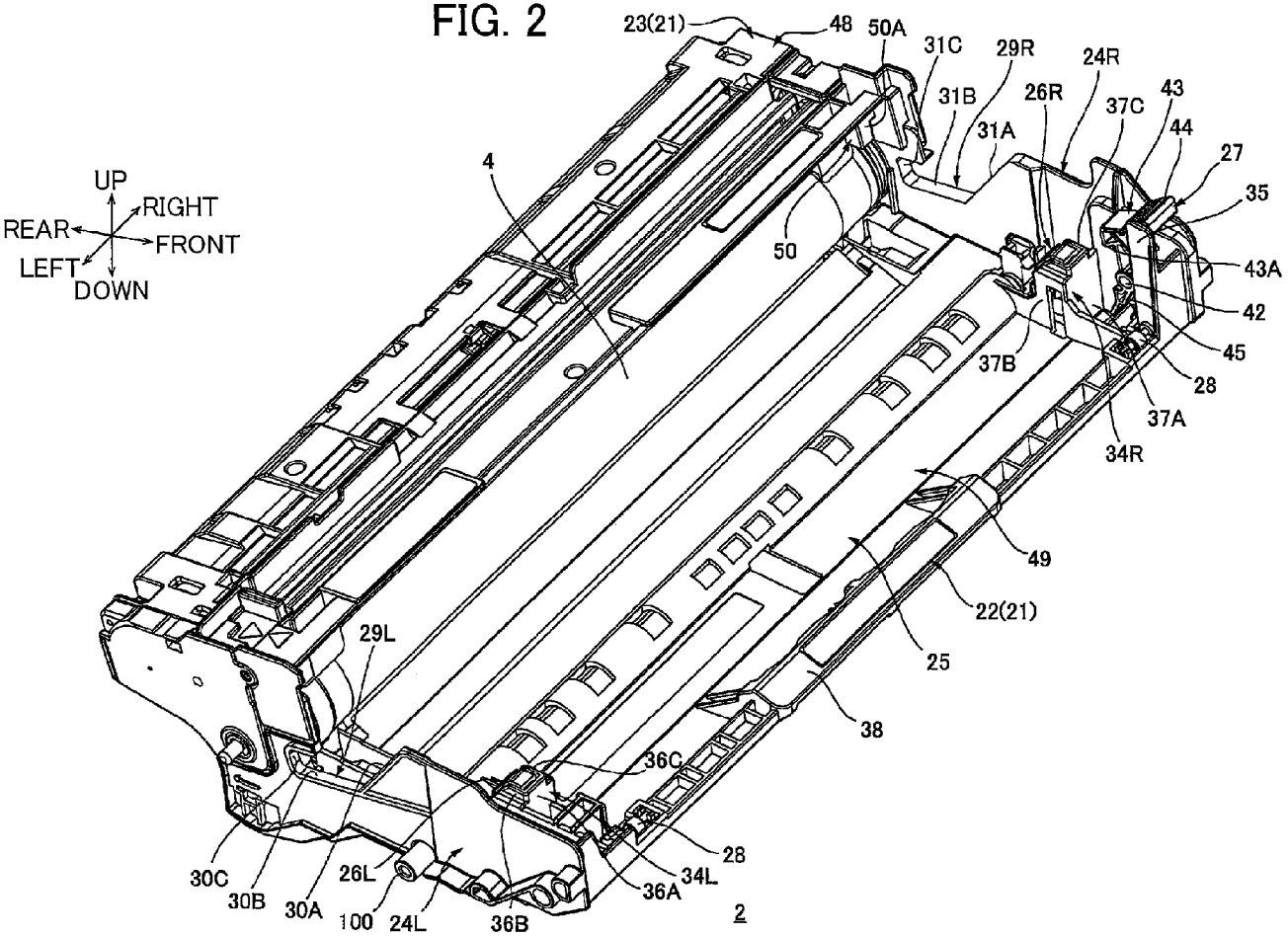
FIG. 2 is a perspective view of the drum cartridge according to the embodiment as viewed from an upper-front perspective.

As illustrated in FIG. 2, the drum cartridge 2 has a tray-like shape whose front and upper end portions are open. The drum cartridge 2 has a rectangular shape in a plan view. The drum cartridge 2 mainly includes a drum frame 21, a pair of pressing members 26L and 26R, a locking member (locking lever) 27, and a pair of rollers 28.

(1) Drum Frame

The drum frame 21 includes a base frame 22 and a cover frame 23.

(1-1) Base Frame

The base frame 22 constitutes a lower half of the drum frame 21. The base frame 22 includes a pair of side walls 24L and 24R, and a lower wall 25, but is not provided with a front wall.

The side wall 24L constitutes a left end portion of the base frame 22. The side wall 24L has a generally rectangular plate-like shape and extends in a front-rear direction in a side view. The side wall 24L includes a guide groove 29L.

The guide groove 29L is formed in a center portion of the side wall 24L in the front-rear direction. The guide groove 29L is recessed downward from an upper edge of the side wall 24L and has a generally U shape that is open upward in a side view. The guide groove 29L includes a first guide surface 30A, a second guide surface 30B, and a fitting part 30C.

The first guide surface 30A is a peripheral surface of a frontward portion constituting the guide groove 29L. The first guide surface 30A extends rearward and downward from the upper edge of the side wall 24L.

The second guide surface 30B is a peripheral surface of a lower portion constituting the guide groove 29L. The second guide surface 30B is connected to a lower end of the first guide surface 30A and extends rearward therefrom.

The fitting part 30C is disposed on a lower-rear end of the guide groove 29L. The fitting part 30C is a groove that is recessed rearward from the peripheral surface of a rearward portion constituting the guide groove 29L. That is, in a side view, the fitting part 30C has a generally U-shape whose front end is opened. The fitting part 30C has a lower surface that is connected to the second guide surface 30B.

Figure 3:
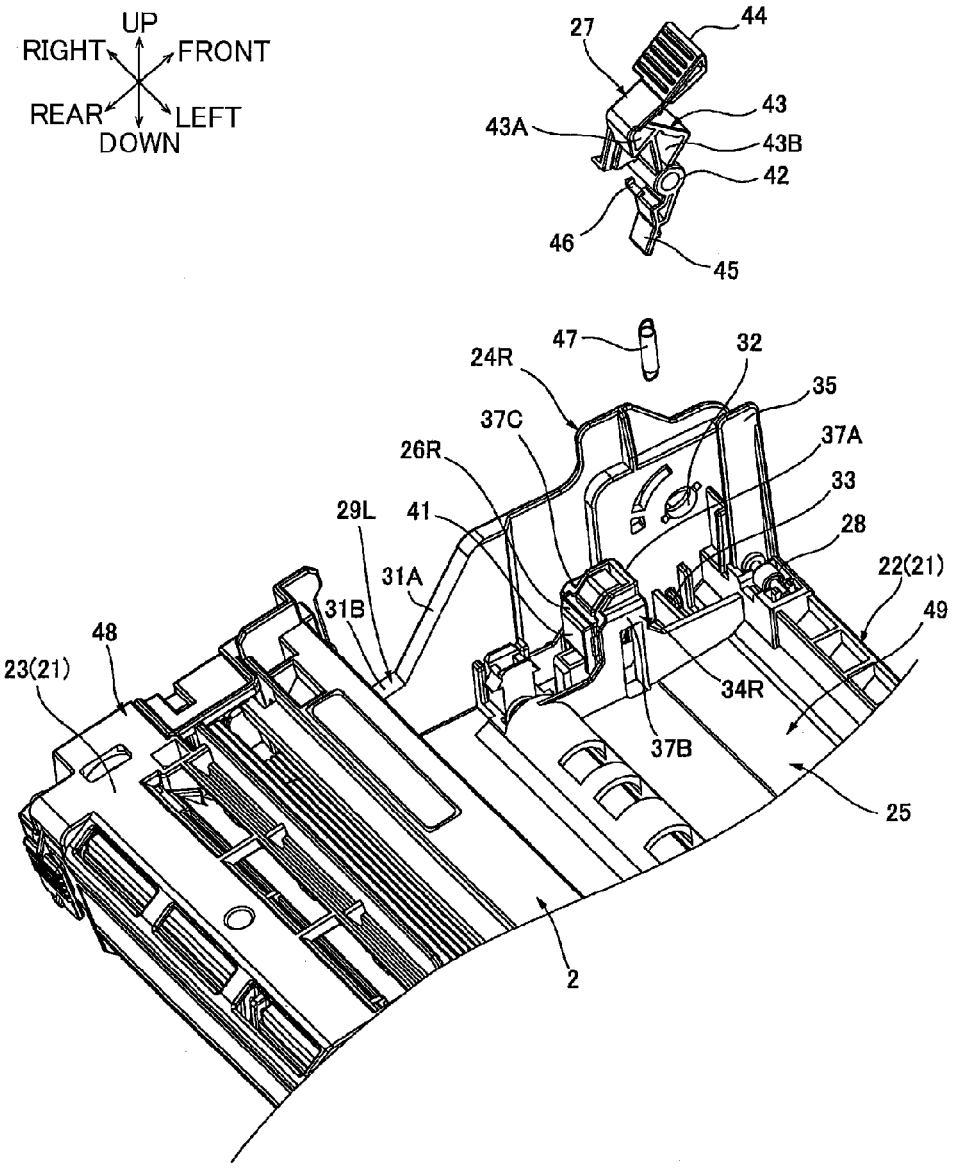
FIG. 3 is a partially-enlarged perspective view showing a right end portion of the drum cartridge according to the embodiment as viewed from an upper-rear perspective, wherein a locking member and a torsion spring are removed from the drum cartridge.

As illustrated in FIGS. 2 and 3, the side wall 24R constitutes a right end portion of the base frame 22. The side wall 24R has a rectangular plate shape in a side view and extends in the front-rear direction. The side wall 24R includes a guide groove 29R, a lock support hole 32, and a locking protrusion 33.

The guide groove 29R is arranged at a generally center portion of the side wall 24R in the front-rear direction. The guide groove 29R is recessed downward from an upper peripheral edge of the side wall 24R. The guide groove 29R has a general U-shape that is open upward in a side view. The guide groove 29R includes a first guide surface 31A, a second guide surface 31B, and a fitting part 31C.

The first guide surface 31A is a peripheral surface of a frontward portion constituting the guide groove 29R. The first guide surface 31A extends rearward and downward from the upper peripheral edge of the side wall 24R.

The second guide surface 31B is a peripheral surface of a lower portion constituting the guide groove 29R. The second guide surface 31B is connected to a lower end of the first guide surface 31A and extends rearward therefrom.

The fitting part 31C is disposed on a lower-rear end of the guide groove 29R. The fitting part 31C is a groove that is recessed rearward from a peripheral surface of a rearward portion constituting the guide groove 29R. The fitting part 31C has a general U-shape that is open frontward in a side view. The fitting part 31C has a lower surface that is connected to the second guide surface 31B.

The lock support hole 32 is formed in a front end portion of the side wall 24R. The lock support hole 32 penetrates the side wall 24R in the left-right direction and has a circular shape in a side view.

The locking protrusion 33 is disposed generally below the lock support hole 32. The locking protrusion 33 extends leftward from a left surface of the side wall 24R and has a left end portion that is bent downward. The locking protrusion 33 thus has a hook-like shape.

Figure 4:
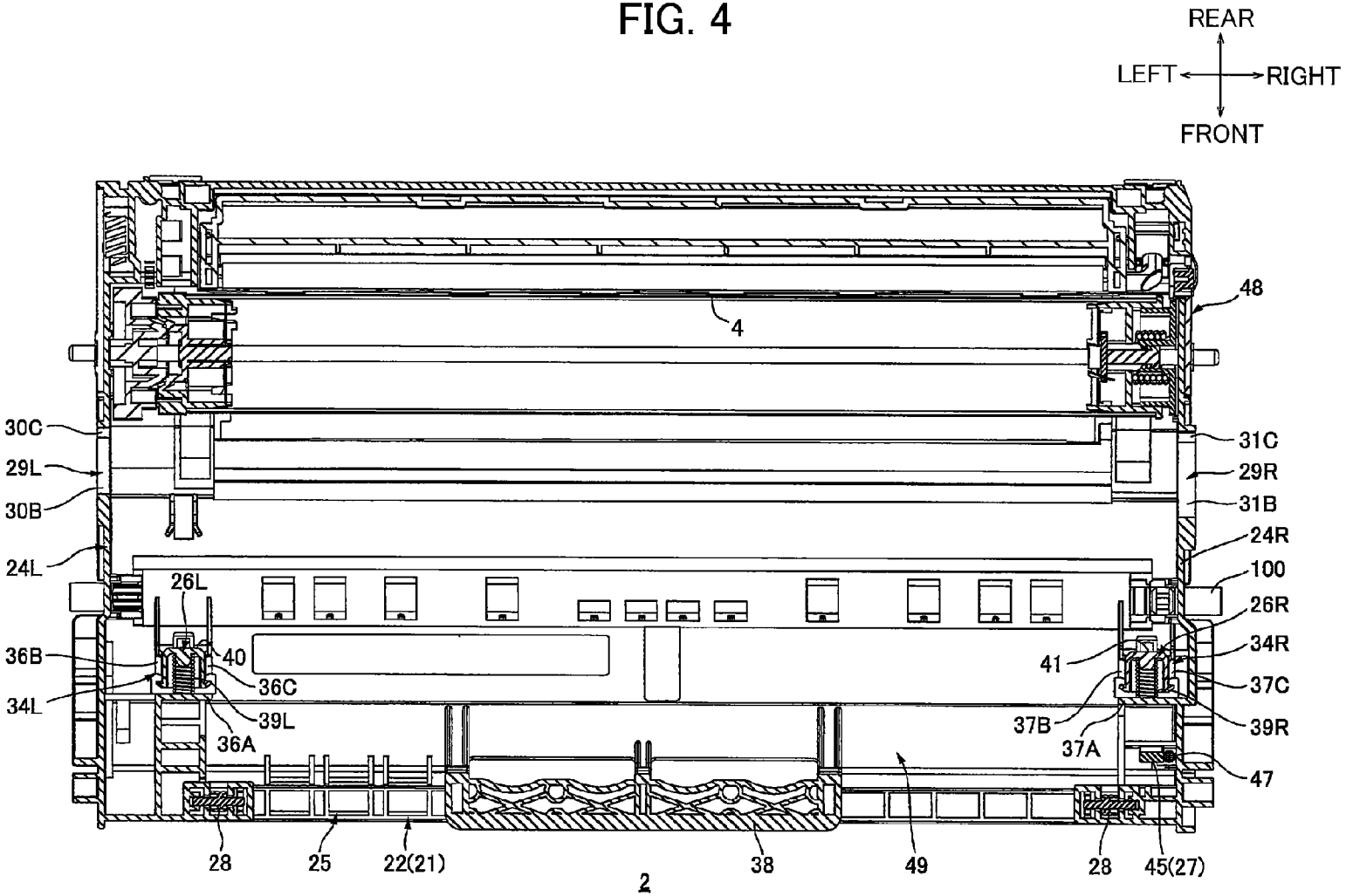
FIG. 4 is a cross-sectional view of the drum cartridge according to the embodiment taken along a plane A-A shown in FIG. 11.

As illustrated in FIGS. 2 and 4, the lower wall 25 is arranged to connect between lower ends of the side wall 24L and the side wall 24R. The lower wall 25 extends in the left-right direction and has a rectangular plate shape in a top view.

The lower wall 25 has a left end that is connected to the lower end of the side wall 24L, and a right end that is connected to the lower end of the side wall 24R. The lower wall 25 includes a pressing support portion 34L, a pressing support portion 34R and a wall portion 35.

The pressing support portion 34L is disposed on a left end portion of the lower wall 25. The pressing support portion 34L is arranged frontward of the guide groove 29L. The pressing support portion 34L extends upward from an upper surface of the lower wall 25. The pressing support portion 34L has a rectangular cylindrical shape whose rear end portion is open. The pressing support portion 34L includes a front wall 36A, a left wall 36B, and a right wall 36C.

The front wall 36A constitutes a front end portion of the pressing support portion 34L. The front wall 36A extends in the left-right direction and has a rectangular plate-like shape in the front view.

The left wall 36B constitutes a left end portion of the pressing support portion 34L. The left wall 36B extends in the front-rear direction and has a rectangular plate-like shape in a side view. The left wall 36B has a front end that is connected to a left end of the front wall 36A.

The right wall 36C constitutes a right end portion of the pressing support portion 34L. The right wall 36C extends in the front-rear direction and has a rectangular plate-like shape in a side view. The right wall 36C has a front end that is connected to a right end of the front wall 36A.

The pressing support portion 34L is configured to movably receive the pressing member 26L therein for guiding movement of the pressing member 26L in the front-rear direction, as will be described later.

The pressing support portion 34R is disposed on a right end portion of the lower wall 25. The pressing support portion 34R is arranged frontward of the guide groove 29R and rearward of the lock support hole 32 (see FIG. 3) such that the pressing support portion 34R is aligned with the pressing support portion 34L in the left-right direction (or, put other way, the pressing support portion 34R and pressing support portion 34L are coincident with each other when viewed in the left-right direction). That is, the pressing support portion 34R is disposed between the photosensitive drum 4 and the lock support hole 32 in the front-rear direction.

The pressing support portion 34R extends upward from the upper surface of the lower wall 25, and has a rectangular cylindrical shape whose rear end is open. The pressing support portion 34R includes a front wall 37A, a left wall 37B, and a right wall 37C.

The front wall 37A constitutes a front end portion of the pressing support portion 34R. The front wall 37A extends in the left-right direction and has a rectangular plate-like shape in a front view.

The left wall 37B constitutes a left end portion of the pressing support portion 34R. The left wall 37B extends in the front-rear direction and has a rectangular plate-like shape in a side view. The left wall 37B has a front end that is connected to a left end of the front wall 37A.

The right wall 37C constitutes a right end portion of the pressing support portion 34R. The right wall 37C extends in the front-rear direction and has a rectangular plate-like shape in a side view. The right wall 37C has a front end that is connected to a right end of the front wall 37A.

The pressing support portion 34R is configured to movably receive the pressing member 26R therein for guiding movement of the pressing member 26R in the front-rear direction, as will be described later.

The wall portion 35 is provided at a front end portion of the lower wall 25 on the right end thereof. The wall portion 35 is disposed leftward of the side wall 24R to be spaced away therefrom. The wall portion 35 is positioned frontward of the lock support hole 32. The wall portion 35 extends upward from the upper surface of the lower wall 25. The wall portion 35 extends in the front-rear direction and has a rectangular plate-like shape in a side view.

(1-2) Cover Frame

As illustrated in FIG. 2, the cover frame 23 is disposed upward of a rear end portion of the base frame 22 for covering the photosensitive drum 4. The cover frame 23 supports the scorotron charger 5. The cover frame 23 includes a contact part 50.

The contact part 50 is arranged at a front end portion of the cover frame 23 on a right end thereof. The contact part 50 extends downward from an upper wall constituting of the cover frame 23. The contact part 50 has a rectangular cylindrical shape. The contact part 50 has a front surface 50A that is flat and extends in an up-down direction.

In the drum cartridge 2, the cover frame 23, a rear end portion of the side wall 24L, a rear end portion of the side wall 24L and a rear end portion of the lower wall 25 define a drum supporting section 48. The drum supporting section 48 is a box-shaped section for supporting the photosensitive drum 4.

Further, in the drum cartridge 2, a tray-shaped portion positioned frontward of the drum supporting section 48 serves as a developing cartridge attachment section 49 to which the developing cartridge 3 is attached. That is, the developing cartridge attachment section 49 is defined by a frontward portion of the side wall 24L, a frontward portion of the side wall 24R, and a frontward portion of the lower wall 25.

(2) Pressing Members

Referring to FIG. 4, the pressing member 26L is disposed between the left wall 36B and the right wall 36C constituting the pressing support portion 34L. The pressing member 26L is configured to abut against a pressing protrusion 60L of the developing cartridge 3 (described later) for pressing the developing cartridge 3 toward the photosensitive drum 4. The pressing member 26L has a rectangular cylindrical shape whose rear end is closed. The pressing member 26L has a rear surface 40 that is a flat surface extending in the up-down direction and left-right direction. A compression spring 39L is arranged between a rear wall of the pressing member 26L and the front wall 36A of the pressing support portion 34L. The pressing member 26L is thus normally urged rearward by the compression spring 39L.

The pressing member 26R is disposed between the photosensitive drum 4 and the locking member 27 in the front-rear direction. Referring to FIG. 4, the pressing member 26R is disposed between the left wall 37B and the right wall 37C of the pressing support portion 34R. The pressing member 26R is configured to contact a pressing protrusion 60R of the developing cartridge 3 (described later) for pressing the developing cartridge 3 toward the photosensitive drum 4. The pressing member 26R has a rectangular cylindrical shape whose rear end is closed. The pressing member 26R has a rear surface 41 that is a flat surface extending in the up-down direction and left-right direction. A compression spring 39R is arranged between a rear wall of the pressing member 26R and the front wall 37A of the pressing support portion 34R. The pressing member 26R is thus normally urged rearward by the compression spring 39R. The compression spring 39R is positioned between the photosensitive drum 4 and the locking member 27 in the front-rear direction. That is, the compression spring 39R is disposed between the locking member 27 and the pressing member 26R in the front-rear direction.

(3) Locking Member and Tension Spring

As illustrated in FIGS. 2 and 3, the locking member 27 is supported by a front end portion of the side wall 24R. The locking member 27 is positioned between the side wall 24R and the wall portion 35 in the left-right direction. More specifically, the locking member 27 is configured to pivot between a restricting position (see FIG. 12) and a non-restricting position (see FIG. 15). In the restricting position, the locking member 27 engages an engagement protrusion 64 of the developing cartridge 3 (described later) to restrict detachment of the developing cartridge 3 from the drum cartridge 2. In the non-restricting position, the locking member 27 is disengaged from the engagement protrusion 64 to allow detachment of the developing cartridge 3 from the drum cartridge 2.

Hereinafter, the locking member 27 will be described based on an assumption that the locking member 27 is at the restricting position. The locking member 27 includes: a shaft 42; an operation arm including a restricting part 43 and an operation part 44; and a lift arm including a lifting part 45 and a locking protrusion 46.

The shaft 42 has a columnar shape extending in the left-right direction. The shaft 42 is rotatably fitted into the lock support hole 32 formed in the side wall 24R.

The restricting part 43 extends upward from an upper peripheral surface of the shaft 42. The restricting part 43 includes a claw 43A and a base 43B.

The base 43B has a rectangular cylindrical shape that extends in the left-right direction. The base 43B has a lower end that is connected to the upper peripheral surface of the shaft 42. The claw 43A protrudes rearward and downward from an upper end portion of the base 43B. That is, the claw 43A extends from the upper end portion of the base 43B toward the photosensitive drum 4. The claw 43A has a wedge-like shape whose lower rear end portion constitutes an apex in a side view.

The operation part 44 extends forward from an upper end portion of the restricting part 43 (claw 43A) and has a rectangular plate-like shape in a plan view. The operation part 44 has a front end portion that is positioned rightward of the wall portion 35 to oppose the wall portion 35, when the locking member 27 is at the restricting position.

The lifting part 45 extends rearward and downward from a lower peripheral surface of the shaft 42 and has a rectangular plate-like shape in a plan view.

The locking protrusion 46 extends rightward from a right surface of the lifting part 45 and has a right end portion that is bent upward to provide a hook-like shape.

A tension spring (urging member) 47 is provided between the locking member 27 and the side wall 24R to urge the locking member 27 toward the restricting position. The tension spring 47 is a tension coil spring that extends in the up-down direction. The tension spring 47 has an upper end engaged with the locking protrusion 46 of the locking member 27, and has a lower end engaged with the locking protrusion 33 of the side wall 24R. The tension spring 47 has a natural length when the locking member 27 is at the restricting position.

(4) Rollers, Grip Part and Conveying Roller

The pair of rollers 28 is disposed one on respective left and right end portions of a frond end portion of the lower wall 25. The rollers 28 have a columnar shape that extends in the left-right direction. The rollers 28 are rotatably supported on an upper surface of the lower wall 25. That is, the rollers 28 are positioned such that the locking member 27 is disposed between the rollers 28 and the photosensitive drum 4 in the front-rear direction.

A grip part 38 is formed on a center portion of the front end portion of the lower wall 25 in the left-right direction. The grip part 38 has an upper surface that is lower than upper end portions of the rollers 28.

Further, a conveying roller 100 is disposed on a lower surface of the lower wall 25 at a position generally center in the front-rear direction. The conveying roller 100 has a columnar shape that extends in the left-right direction. The conveying roller 100 has a left end that protrudes leftward relative to the side wall 24L, and a right end that protrudes rightward relative to the side wall 24R.

3. Detailed Structure of the Developing Cartridge

Figure 5:
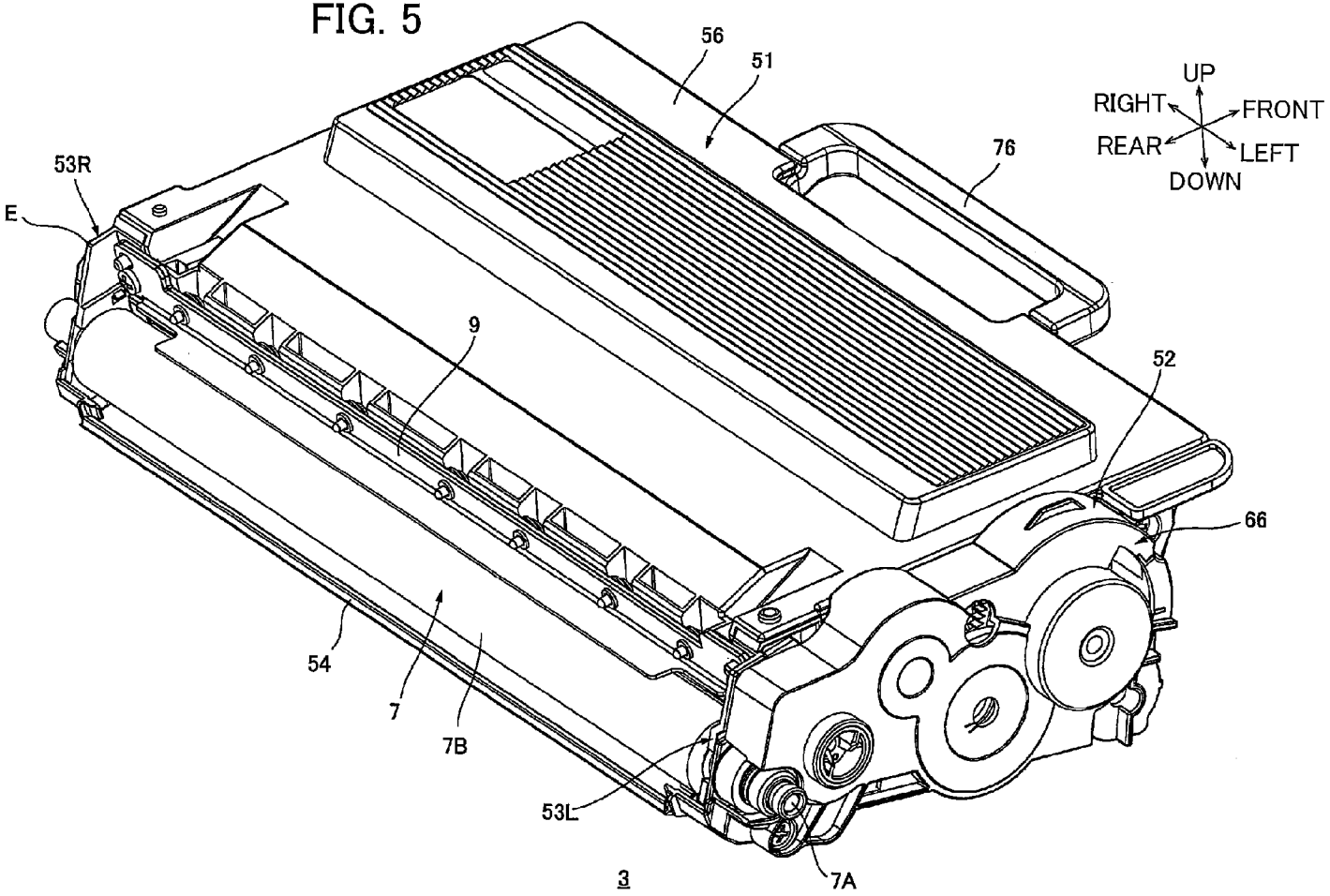
FIG. 5 is a perspective view of the developing cartridge according to the embodiment as viewed from an upper-rear perspective.
Figure 6:
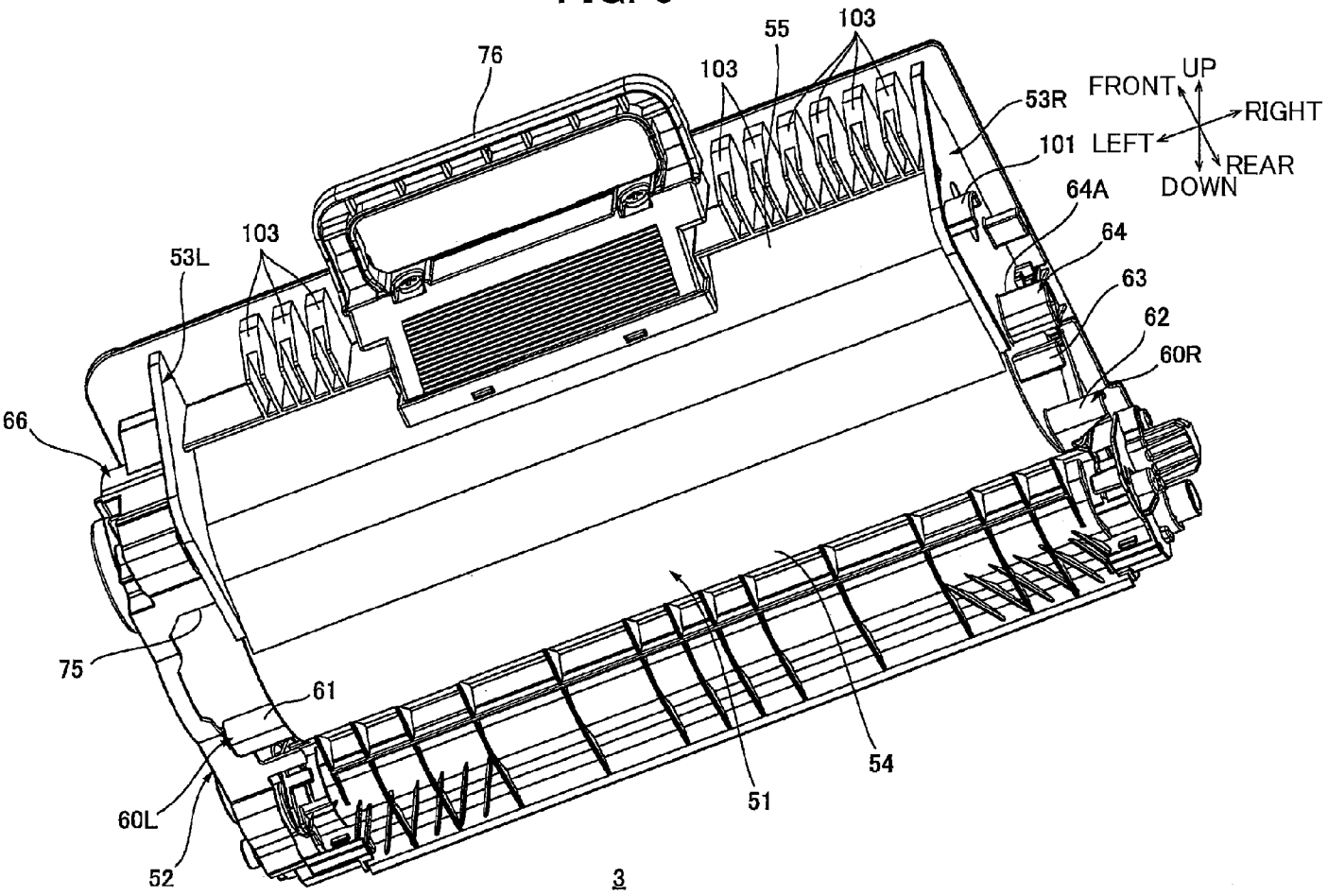
FIG. 6 is a perspective view of the developing cartridge according to the embodiment as viewed from a lower-front perspective.

As illustrated in FIGS. 5 and 6, the developing cartridge 3 includes a developing frame 51 and a drive part 52.

(1) Developing Frame

Figure 8:
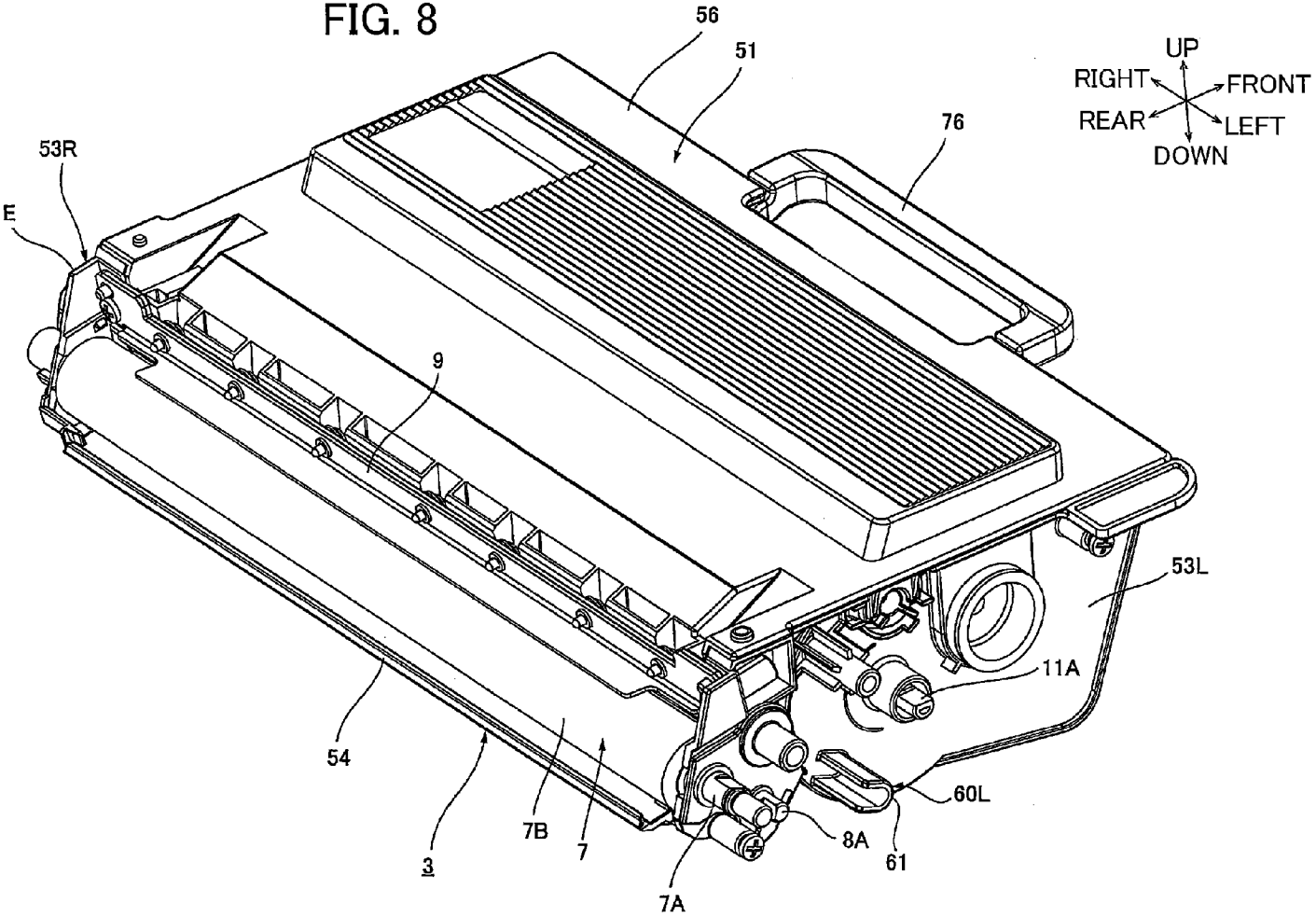
FIG. 8 is a perspective view showing a developing frame of the developing cartridge according to the embodiment as viewed from an upper-rear perspective.

As illustrated in FIGS. 6 and 8, the developing frame 51 has a box-like shape. The developing frame 51 includes the toner storage portion 10, and supports the developing roller 7, the supply roller 8, and the thickness regulation blade 9. The developing frame 51 includes a pair of side walls 53L and 53R, a lower wall 54, a front wall 55, and an upper wall 56.

As illustrated in FIG. 8, the side wall 53L constitutes a left end portion of the developing frame 51. The side wall 53L has a rectangular plate-like shape that extends in the front-rear direction in a side view. The side wall 53L includes the pressing protrusion 60L configured to be pressed by the pressing member 26L when the developing cartridge 3 is attached to the drum cartridge 2.

The pressing protrusion 60L is arranged on a lower end portion of the side wall 53L generally below the agitator shaft 11A. The pressing protrusion 60L extends leftward from a left surface of the side wall 53L and has a general U-shape that is open rearward in a side view. The pressing protrusion 60L has a curved front surface 61 whose center portion in the up-down direction projects frontward.

Figure 12:
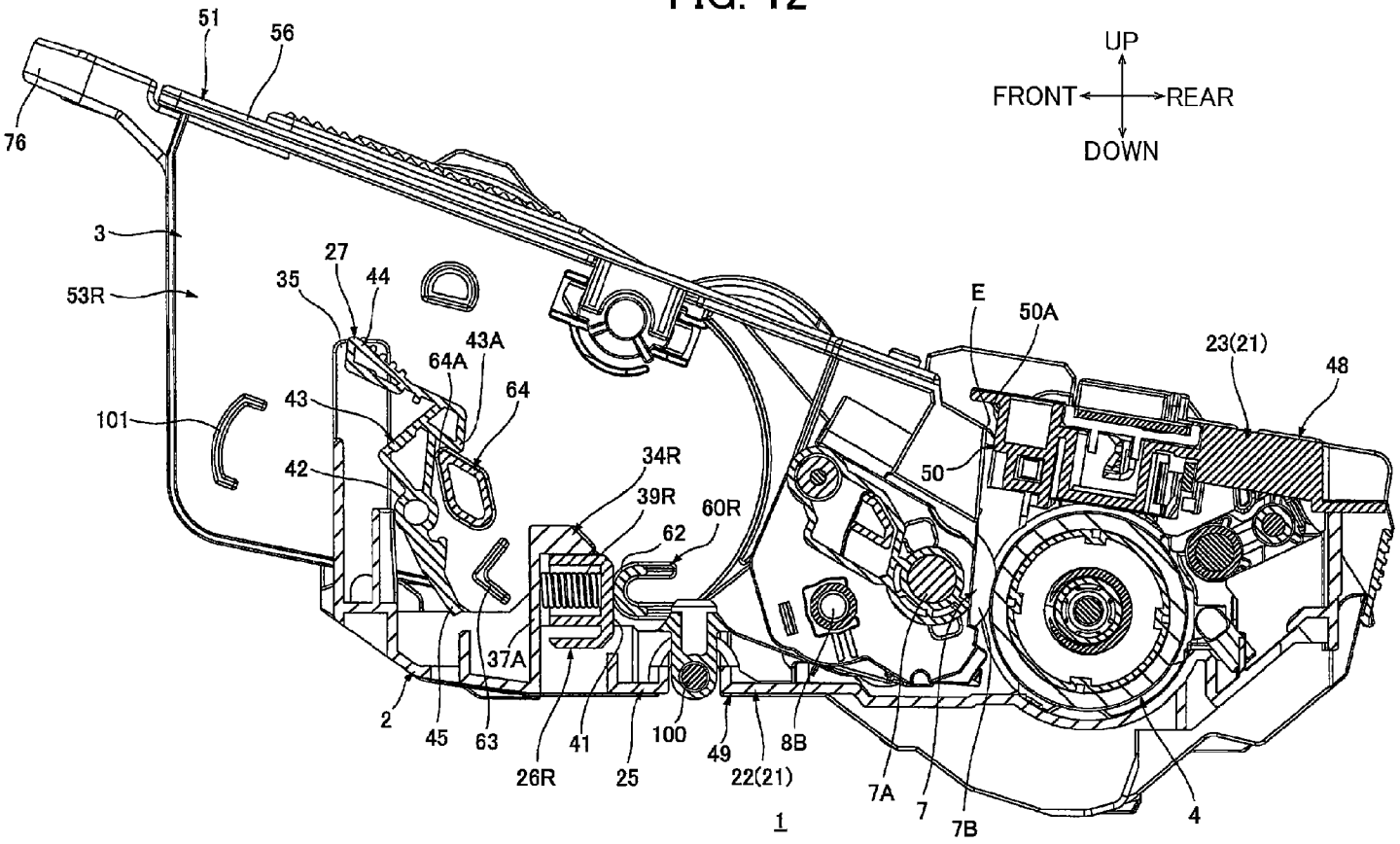
FIG. 12 is a cross-sectional view showing the internal structure of the process cartridge according to the embodiment taken along a plane D-D shown in FIG. 10.

As illustrated in FIGS. 6 and 12, the side wall 53R constitutes a right end portion of the developing frame 51. The side wall 53R has a rectangular plate-like shape that extends in the front-rear direction in a side view. The side wall 53R includes the pressing protrusion 60R, a contact protrusion 63, the engagement protrusion 64, and a contact part 101.

The pressing protrusion 60R is arranged on a lower end portion of the side wall 53R at a position coincident with the pressing protrusion 60L when viewed in the left-right direction. That is, the pressing protrusion 60R and pressing protrusion 60L are aligned with each other in the left-right direction. The pressing protrusion 60R extends rightward from a right surface of the side wall 53R and has a general U-shape that is open rearward in a side view. The pressing protrusion 60R has a curved front surface 62 whose center portion in the up-down direction projects forward.

The contact protrusion 63 is disposed frontward of the pressing protrusion 60R. The contact protrusion 63 extends rightward from the right surface of the side wall 53R and has a generally L-shape in a side view.

The engagement protrusion 64 is disposed upward and frontward of the pressing protrusion 60R. The engagement protrusion 64 extends rightward from the right surface of the side wall 53R and has a generally rectangular cylindrical shape. The engagement protrusion 64 has an upper front end portion 64A that has a wedge-like shape in a side view. The wedge-shaped upper front end portion 64A has an apex portion that is directed upward and frontward in a side view.

The contact part 101 is disposed on a front end portion of the side wall 53R. The contact part 101 extends rightward from the right surface of the side wall 53R and has a U-shape whose rear end is open in a side view. The contact part 101 has a front surface that is curved such that a center portion thereof in the up-down direction projects forward. The contact part 101 is configured to be pressed rearward by a front cover 86 (described later) toward the photosensitive drum 4 when the process cartridge 1 is mounted on a main body 82 (see FIG. 16).

The lower wall 54 has a plate-like shape that extends in the front-rear direction. The lower wall 54 has a left end connected to a lower end of the side wall 53L, and a right end connected to a lower end of the side wall 53R.

The front wall 55 has a plate-like shape and is connected to a front end of the lower wall 54 to extend upward therefrom. The front wall 55 has a left end connected to a front end of the side wall 53L, and a right end connected to a front end of the right wall 53R. The front wall 55 includes a gripping part 76 and a plurality of protrusions 103.

The gripping part 76 is disposed at a left-right center portion of the front wall 55 on a front end thereof. The gripping part 76 protrudes forward from the front end of the front wall 55 and has a rectangular frame-like shape in a plan view.

Figure 9:
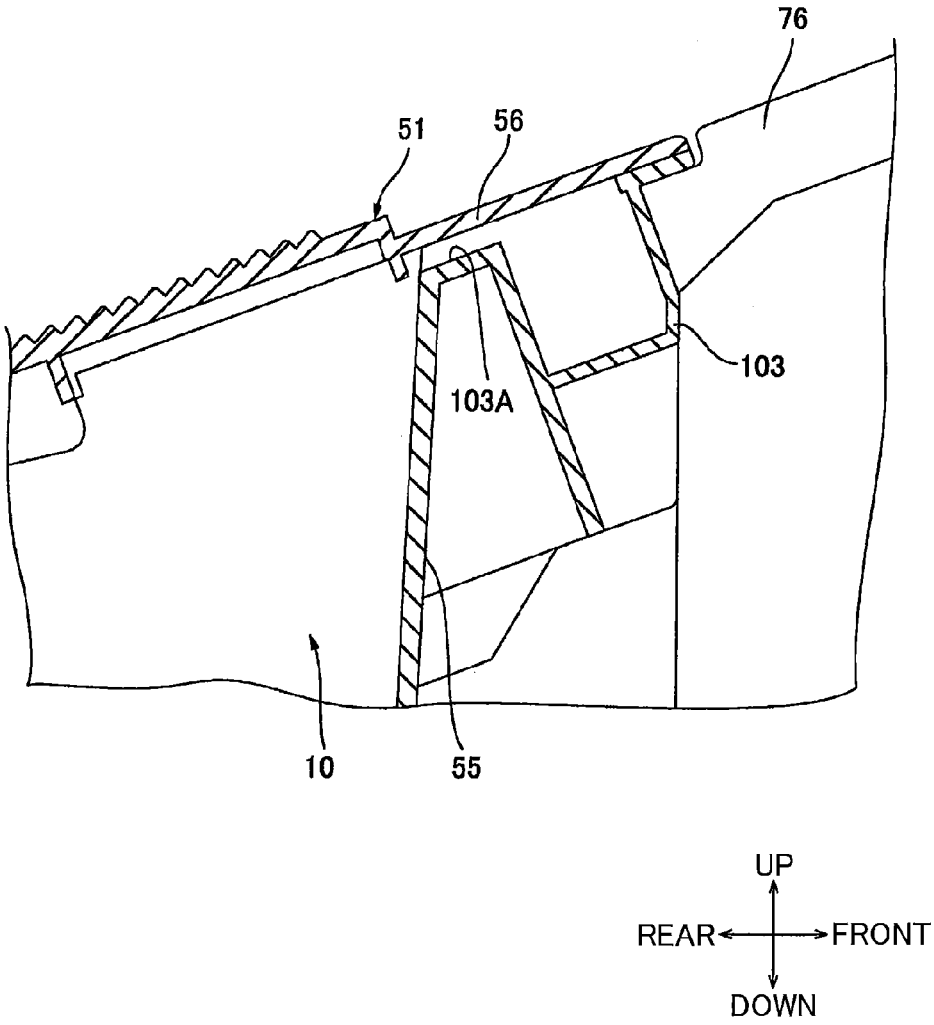
FIG. 9 is a partially enlarged cross-sectional view showing a portion of the developing frame of the developing cartridge according to the embodiment taken along a plane B-B shown in FIG. 7.

As illustrated in FIGS. 6 and 9, the protrusions 103 protrude forward from the front end of the front wall 55. Each protrusion 103 has a box-like shape and has an upper end portion in communication with the toner storage portion 10. This upper end portion in communication with the toner storage portion 10 is a communication part 103A, and has a length in the up-down direction shorter than a length of an inner space defined by the protrusion 103 in the up-down direction.

With this structure, toner flow from the toner storage portion 10 into the protrusion 103 can be suppressed. Further, even if toner flows into the protrusion 103 from the toner storage portion 10, the toner within the protrusion 103 can be suppressed from flowing back into the toner storage portion 10.

The upper wall 56 has a rectangular plate-like shape in a plan view. The upper wall 56 has a front end fixed to an upper end of the front wall 55, a left end fixed to an upper end of the side wall 53L, and a right end fixed to an upper end of the side wall 53R.

(2) Drive Part

As illustrated in FIG. 5, the drive part 52 is provided on a left end portion of the developing cartridge 3 at a position leftward of the developing frame 51. The drive part 52 includes a gear train (not illustrated) including a plurality of gears, and a gear cover 66 covering the gear train.

Figure 7:
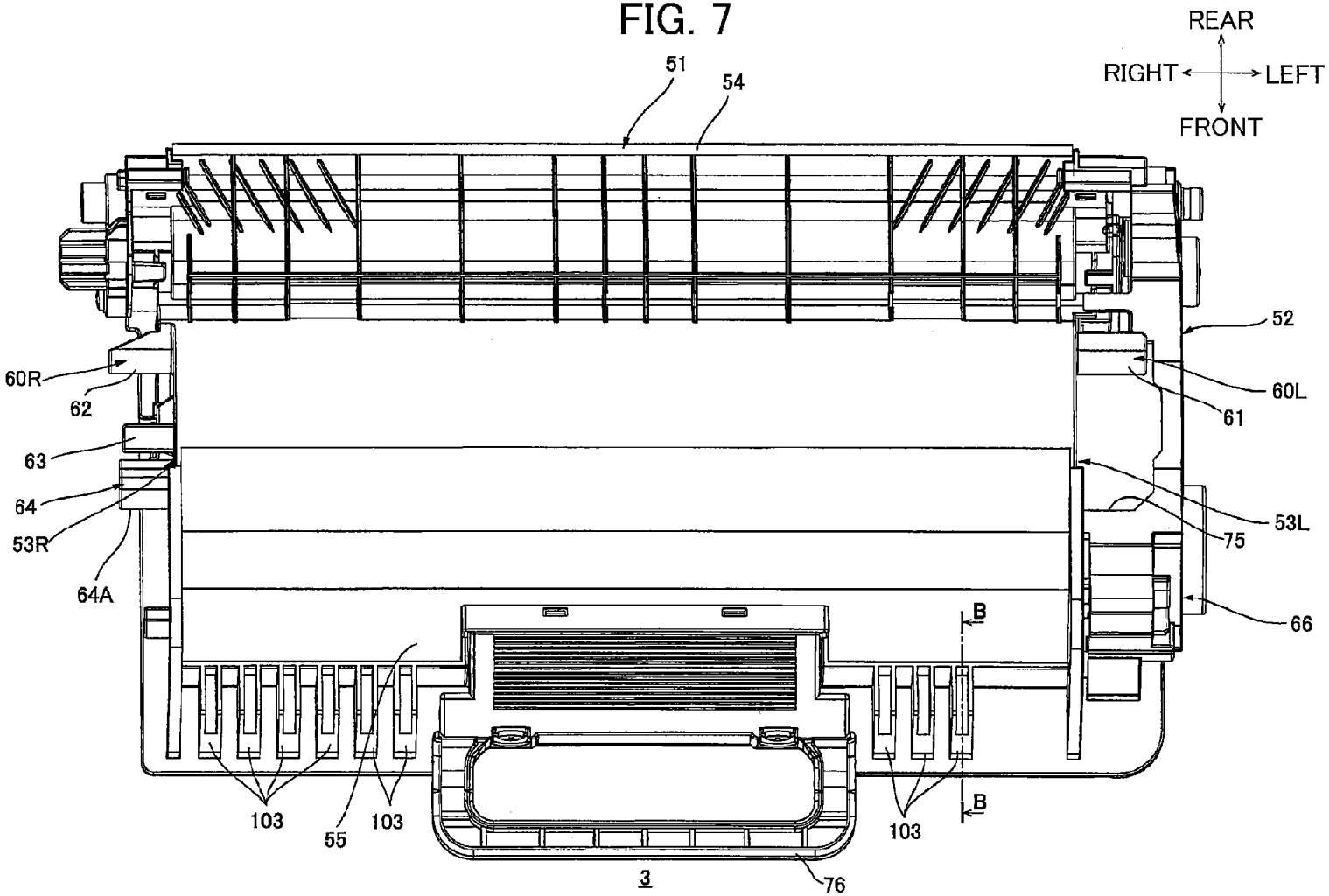
FIG. 7 is a bottom view of the developing cartridge according to the embodiment.
Figure 11:
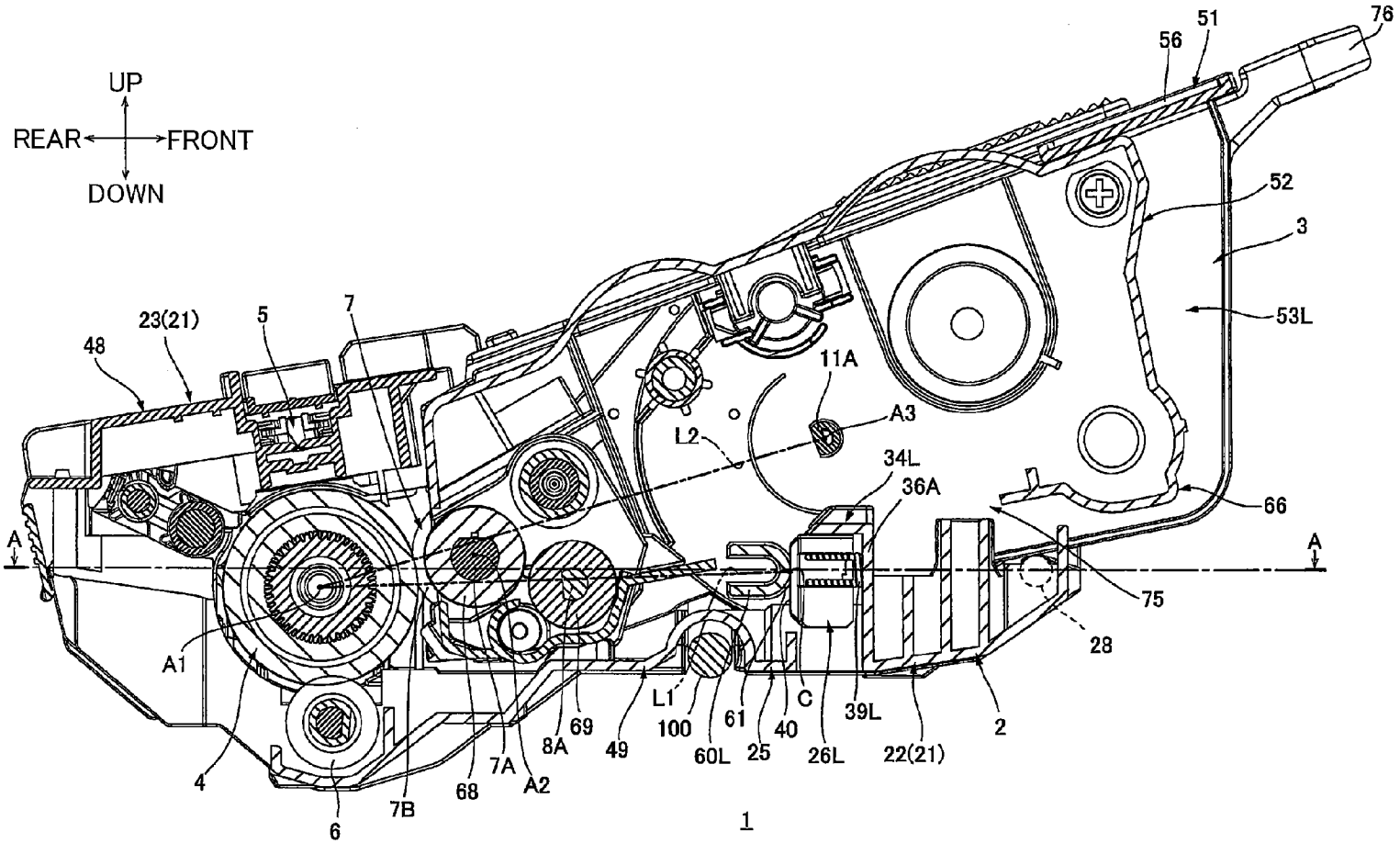
FIG. 11 is a cross-sectional view showing an internal structure of the process cartridge according to the embodiment taken along a plane C-C shown in FIG. 10.

As illustrated in FIGS. 7 and 11, the gear cover 66 includes an opening 75. The pressing protrusion 60L is exposed through the opening 75.

Figure 10:
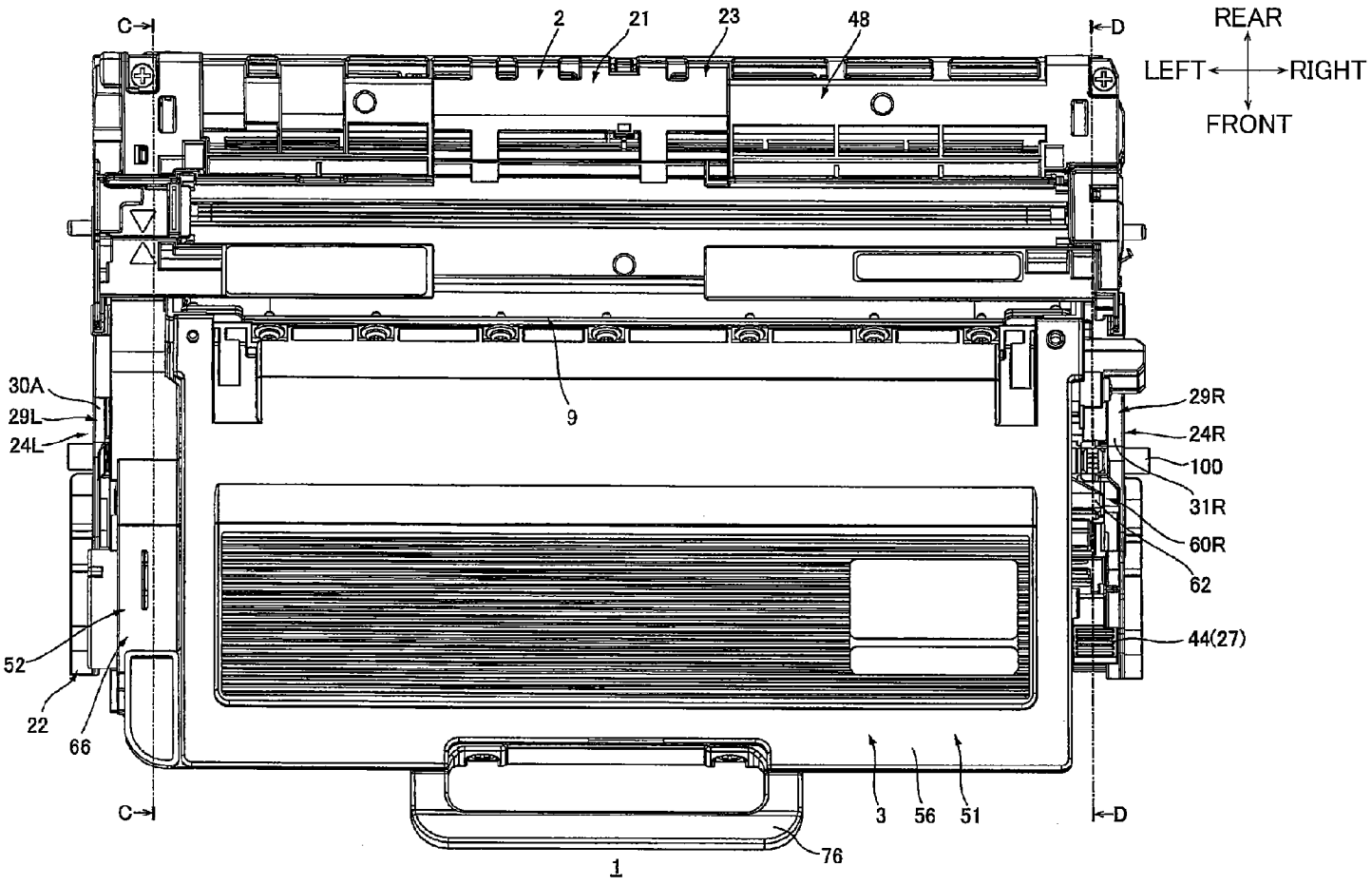
FIG. 10 is a plan view of the process cartridge according to the embodiment.

4. Detachment of the Developing Cartridge from the Drum Cartridge (1) Developing Cartridge Attached to the Drum Cartridge As illustrated in FIGS. 1 and 10, the developing cartridge 3 can be attached to the developing cartridge attachment section 49 of the drum cartridge 2. That is, when the developing cartridge 3 is attached to the drum cartridge 2, the side wall 53L of the developing cartridge 3 is disposed rightward of the side wall 24L to oppose the same. Also, the side wall 53R of the developing cartridge 3 is disposed leftward of the side wall 24R to oppose the same.

When the developing cartridge 3 is attached to the drum cartridge 2, the left end of the developing-roller shaft 7A is fitted into (received in) the fitting part 30C of the guide groove 29L formed in the side wall 24L. Likewise, the right end of the developing-roller shaft 7A is fitted into (received in) the fitting part 31C of the guide groove 29R formed in the side wall 24R. With this structure, the developing roller 7 is fixed in position relative to the photosensitive drum 4 in the up-down direction.

When the developing cartridge 3 is attached to the drum cartridge 2, the front end portion of the developing cartridge 3 is positioned protrudes frontward relative to the front end portion of the drum cartridge 2. The front end portion of the developing cartridge 3 is positioned between the front end portion of the side wall 24L and the front end portion of the side wall 24R of the drum cartridge 2.

Further, as illustrated in FIGS. 1 and 2, the lower end of the side wall 24L and the lower end of the side wall 24R of the developing cartridge 3 respectively contact the pair of rollers 28 of the drum cartridge 2.

Further, as illustrated in FIG. 11, the rear surface 40 of the pressing member 26L contacts the front surface 61 of the pressing protrusion 60L of the developing cartridge 3 and urges the pressing protrusion 60L rearward by the urging force of the compression spring 39L. Likewise, as illustrated in FIG. 12, the rear surface 41 of the pressing member 26R contacts the front surface 62 of the pressing protrusion 60R of the developing cartridge 3 and urges the pressing protrusion 60R rearward by the urging force of the compression spring 39R. Accordingly, the developing cartridge 3 attached to the drum cartridge 2 is urged rearward, thereby enabling the developing roller 7 to be pressed against the photosensitive drum 4.

At this time, the pressing member 26L and the pressing member 26R are respectively disposed between the rollers 28 and the developing roller 7 in the front-rear direction. Further, the pressing member 26R is disposed between the photosensitive drum 4 and the locking member 27 in the front-rear direction. In other words, the pressing member 26R and the photosensitive drum 4 define a distance therebetween that is shorter than a distance defined between the locking member 27 and the photosensitive drum 4.

Further, referring to FIG. 11, assuming that the pressing protrusion 60L and the pressing protrusion 60L are in contact with each other at a contact position C, the rotation axis A1 of the photosensitive drum 4 and the contact position C define a distance L1 therebetween that is shorter than a distance L2 defined between the rotation axis A1 of the photosensitive drum 4 and the rotation axis A3 of the agitator shaft 11A.

It should be noted that, since the pressing protrusion 60L and the pressing protrusion 60R are arranged to be in coincident with each other when viewed in the left-right direction, the rotation axis A1 of the photosensitive drum 4 and a contact position at which the pressing protrusion 60L and the pressing member 26L contact each other also define a distance therebetween that is shorter than the distance L2 between the rotation axis A1 of the photosensitive drum 4 and the rotation axis A3 of the agitator shaft 11A.

Further, as illustrated in FIG. 10, the locking member 27 is disposed between the side wall 53R of the developing cartridge 3 and the side wall 24R of the drum cartridge 2.

As illustrated in FIG. 12, the claw 43A of the restricting part 43 of the locking member 27 is disposed on the upper front end 64A of the engagement protrusion 64 of the developing cartridge 3. That is, the claw 43A is engaged with the engagement protrusion 64. At this time, the lower rear end portion of the lifting part 45 is disposed below and frontward of the contact protrusion 63.

The locking member 27 is at the restricting position and is positioned to be spaced away from the pressing member 26R so as not to interfere with the pressing member 26R.

(2) Detachment of the Developing Cartridge from Drum Cartridge

First, the operation part 44 of the locking member 27 is pressed forward and downward by a user in the state illustrated in FIG. 12. The locking member 27 is caused to pivot counterclockwise about the shaft 42 in a right side view.

Figure 13:
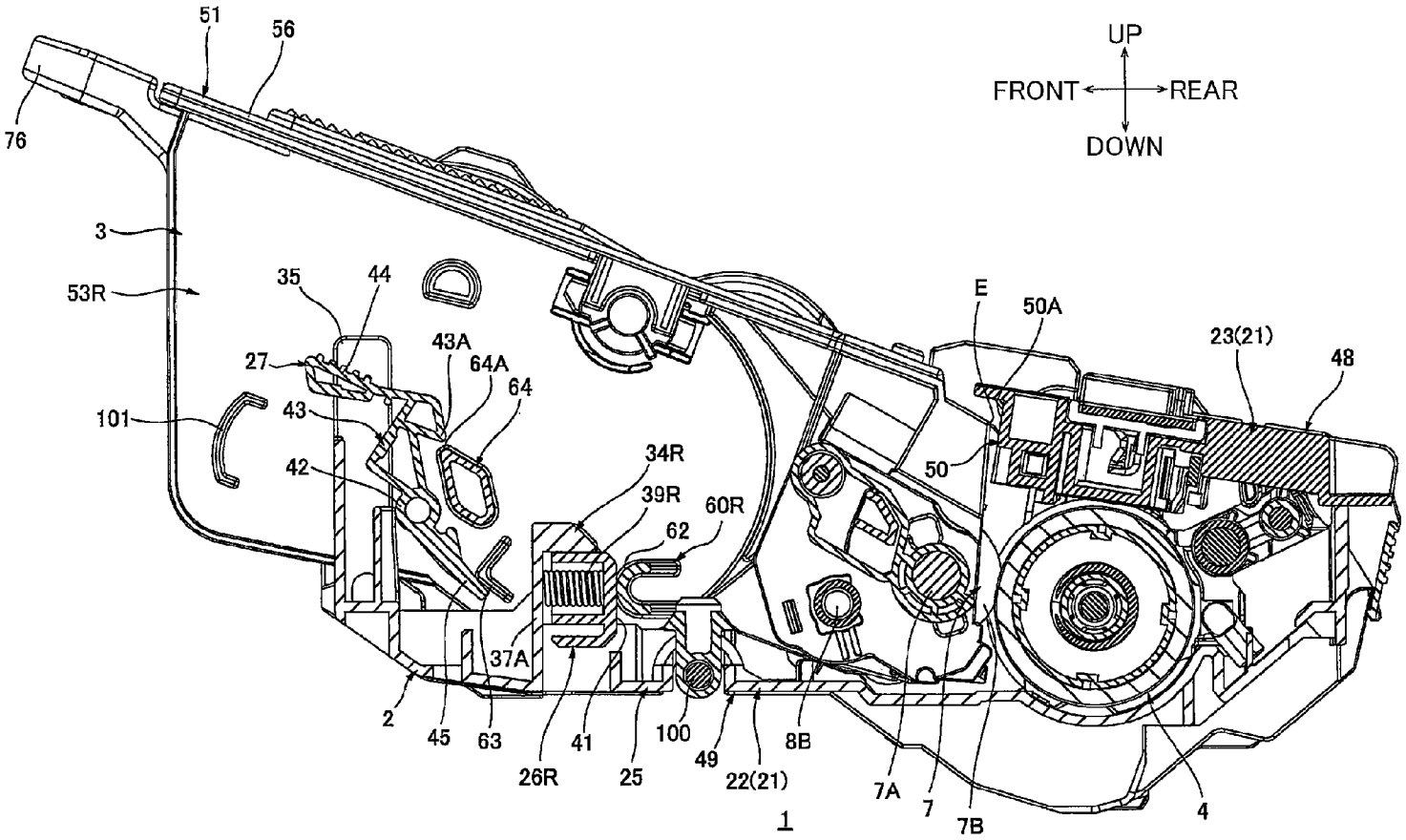
FIG. 13 is an explanatory view illustrating detachment of the developing cartridge from the drum cartridge according to the embodiment after the state of FIG. 12, wherein the locking member is pivotally moved counterclockwise to bring a lifting part into contact with a contact protrusion of the developing cartridge.

Then, as illustrated in FIG. 13, the lifting part 45 contacts the contact protrusion 63 of the developing cartridge 3 from a lower-front side thereof.

As the operation part 44 of the locking member 27 is further pressed forward and downward by the user, the locking member 27 is further caused to pivot counterclockwise about the shaft 42 in a right side view.

The lifting part 45 thus presses the contact protrusion 63 of the developing cartridge 3 rearward and upward so that the right end portion of the developing cartridge 3 is lifted rearward and upward.

Figure 14:
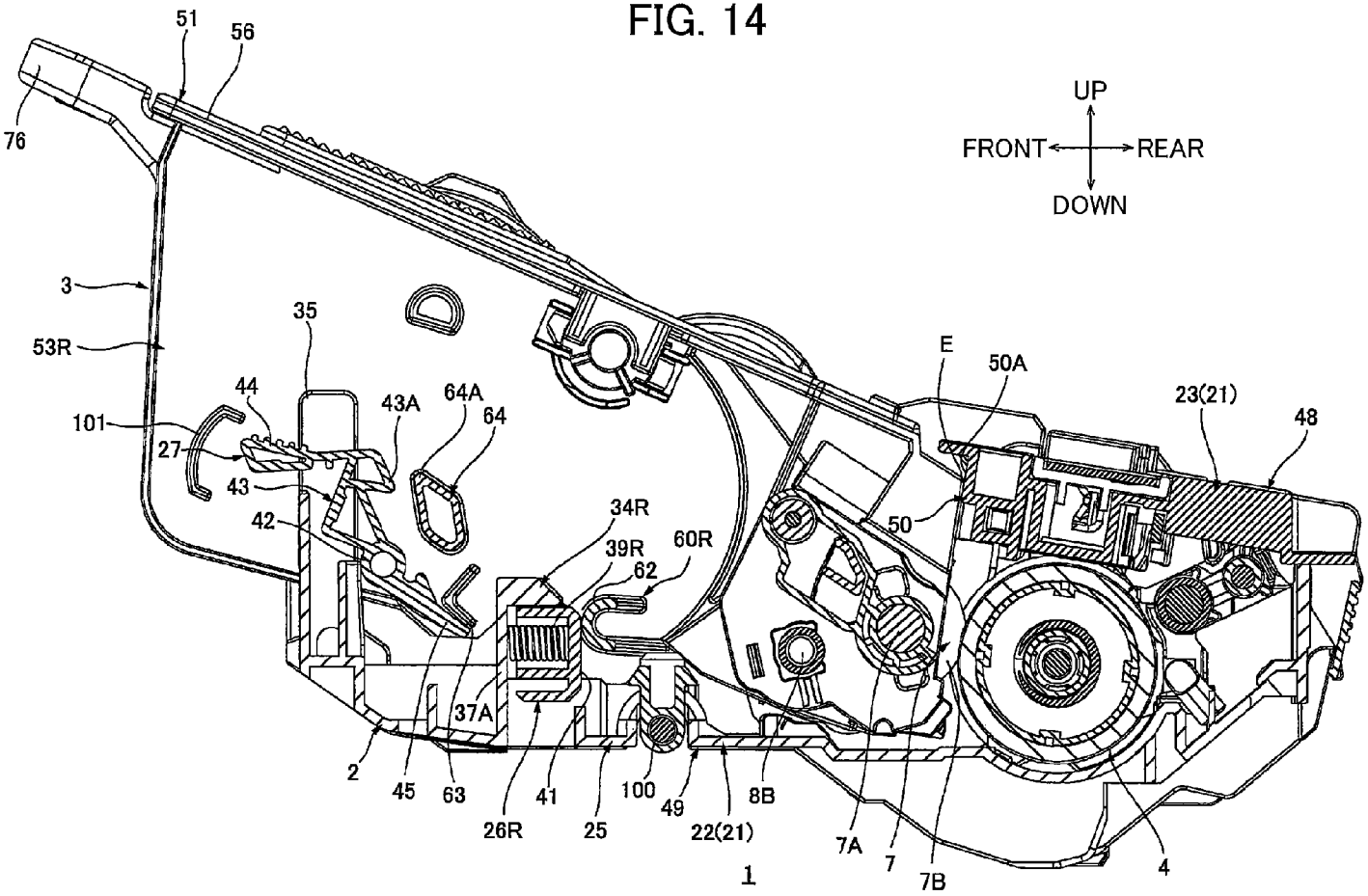
FIG. 14 is an explanatory view illustrating detachment of the developing cartridge from the drum cartridge according to the embodiment after the state of FIG. 13, wherein the developing cartridge is pivotally moved clockwise to bring an upper rear portion of a side wall of the developing frame into contact with a contact part of the drum cartridge.

As a result, as illustrated in FIG. 14, the right end portion of the developing cartridge 3 is caused to pivot clockwise about the rear end portion of the developing roller 7 in a right side view.

At this time, since only the right end portion of the developing cartridge 3 is lifted upward by the locking member 27, the right end portion is caused to slightly deform relative to the left end portion such that the right end portion is twisted clockwise in a right side view relative to the left end portion.

As a result, an upper rear end portion E of the side wall 24R of the developing cartridge 3 is brought into contact with the front surface 50A of the contact part 50 of the cover frame 23 of the drum cartridge 2. Accordingly, the cover frame 23 of the drum cartridge 2 can prevent the right end portion of the developing cartridge 3 from moving further rearward. At this time, the side wall 24L of the developing cartridge 3 does not make contact with the cover frame 23 of the drum cartridge 2.

When the operation part 44 of the locking member 27 is further pressed forward and downward by the user, the locking member 27 is caused to further pivot counterclockwise about the shaft 42 in a right side view.

The lifting part 45 thus further presses the contact protrusion 63 of the developing cartridge 3 upward so that the right end portion of the developing cartridge 3 is lifted further upward.

The right end portion of the developing cartridge 3 is therefore further caused to pivot clockwise about the upper rear end portion E of the side wall 24R of the developing cartridge 3 in a right side view.

Figure 15:
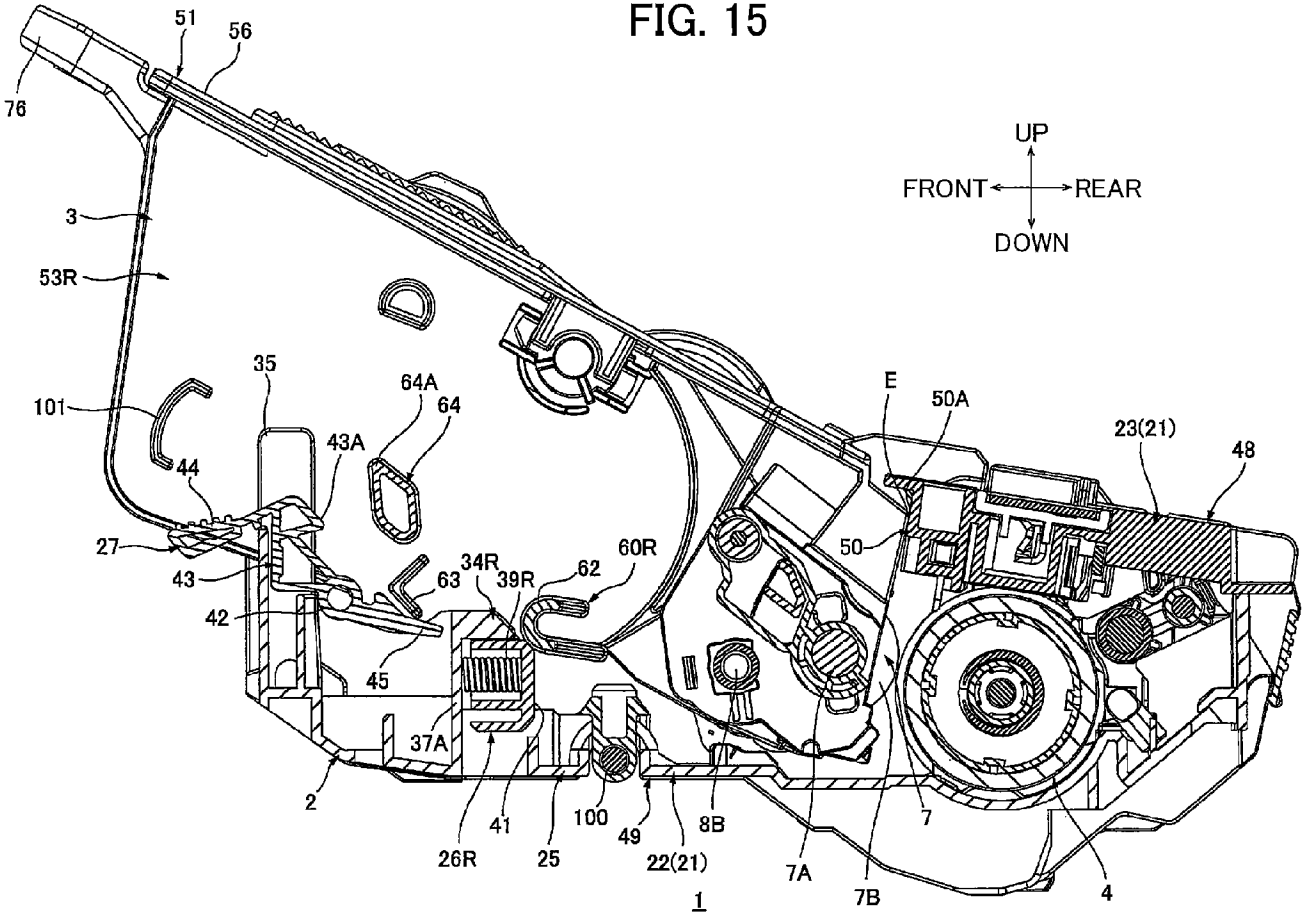
FIG. 15 is an explanatory view illustrating detachment of the developing cartridge from the drum cartridge according to the embodiment after the state of FIG. 14, wherein the locking member is in its non-restricting position and a pressing protrusion of the developing cartridge is disengaged upward from a pressing member of the drum cartridge.

When the locking member 27 reaches the non-restricting position as illustrated in FIG. 15, the pressing protrusion 60R is disengaged upward from the pressing member 26R. Subsequently, deformation of the developing cartridge 3 is restored, and the pressing protrusion 60L is disengaged upward from the pressing member 26L.

When the user lifts the developing cartridge 3 upward by gripping the gripping part 76 at this time, the developing cartridge 3 can be removed upward from the developing cartridge attachment section 49 of the drum cartridge 2.

Detachment of the developing cartridge 3 from the drum cartridge 2 is thus complete.

For attaching the developing cartridge 3 to the drum cartridge 2, the user grips the gripping part 76, inserts the rear end portion of the developing cartridge 3 into the developing cartridge attachment section 49 of the drum cartridge 2 from above, and presses the front end portion of the developing cartridge 3 downward.

In the meantime, the developing roller 7 makes contact with the photosensitive drum 4 from its front side, and the developing cartridge 3 is then caused to pivot clockwise about the rear end thereof in a left side view. The developing cartridge 3 is thus received in and attached to the developing cartridge attachment section 49.

Attachment of the developing cartridge 3 to the drum cartridge 2 is thus complete.

5. How the Process Cartridge is Used

As illustrated in FIG. 16, the process cartridge 1 can be used when mounted in an image forming apparatus 81.

The image forming apparatus 81 is an electro-photographic monochromatic printer. The image forming apparatus 81 includes the main body 82, the process cartridge 1, a scanner unit 83, and a fixing unit 84.

The main body 82 is formed in a box-like shape. The main body 82 includes an opening 85, the front cover 86, a sheet feed tray 87, and a sheet discharge tray 88.

The opening 85 is formed in a front end portion of the main body 82. The opening 85 is formed to establish communication between the inside and the outside of the main body 82 in the front-rear direction. The process cartridge 1 can be mounted in and removed from the main body 82 through the opening 85.

The front cover 86 is disposed on the front end portion of the main body 82. The front cover 86 has a plate-like shape and extends in the up-down direction. The front cover 86 is supported by a front wall of the main body 82 such that the front cover 86 can pivot about a lower end thereof. The front cover 86 is configured to open and close the opening 85.

The sheet feed tray 87 is disposed in a bottom portion of the main body 82. The sheet feed tray 87 is configured to accommodate a stack of sheets P therein.

The sheet discharge tray 88 is formed on an upper wall of the main body 82 to occupy a front half of the same. The sheet discharge tray 88 is recessed downward from an upper surface of the upper wall of the main body 82 for receiving the sheets P thereon.

When mounted in the main body 82, the process cartridge 1 is accommodated in a generally center portion of the main body 82 in the up-down direction. The process cartridge 1 is mounted in or removed from the main body 82 through the opening 85.

The scanner unit 83 is disposed above the process cartridge 1 mounted in the main body 82. The scanner unit 83 is configured to emit a laser beam toward the photosensitive drum 4 based on image data (see a broken line in FIG. 16).

The fixing unit 84 is disposed rearward of the process cartridge 1 mounted in the main body 82. The fixing unit 84 includes a heat roller 89 and a pressure roller 90 in pressure contact with a lower rear portion of the heat roller 89.

When an image forming operation is started in the image forming apparatus 81, the scorotron charger 5 uniformly charges a surface of the photosensitive drum 4. The scanner unit 83 exposes the surface of the photosensitive drum 4. An electrostatic latent image is thus formed on the surface of the photosensitive drum 4 based on image data.

The agitator 11 then rotates about the agitator shaft 11A (rotation axis A3) for agitating the toner within the toner storage portion 10 and supplies the toner to the supply roller 8. That is, the agitator 11 conveys the toner in a direction perpendicular to the rotation axis A3, i.e., frontward. The supply roller 8 then supplies the toner conveyed by the agitator 11 to the developing roller 7. At this time, the toner is tribo-charged positively between the developing roller 7 and the supply roller 8, and is carried on the developing roller 7. The thickness regulation blade 9 regulates the toner carried on the developing roller 7 into a uniform thickness.

Then, the toner carried on the developing roller 7 is supplied to the electrostatic latent image on the surface of the photosensitive drum 4 to form a toner image on the surface of the photosensitive drum 4.

The sheet P is fed, one by one, from the sheet feed tray 87 to a position between the photosensitive drum 4 and the transfer roller 6 at a predetermined timing by rotations of various rollers. The toner image on the surface of the photosensitive drum 4 is transferred onto the sheet P when the sheet P passes between the photosensitive drum 4 and the transfer roller 6.

Subsequently, the sheet P is applied with heat and pressure when passing between the heat roller 89 and the pressure roller 90. The toner image on the sheet P is thus thermally fixed onto the sheet P. The sheet P is finally discharged onto the sheet discharge tray 88.

6. Operational and Technical Advantages (1) According to the process cartridge 1 and the drum cartridge 2 of the embodiment, as illustrated in FIG. 2, the pressing member 26R is positioned closer to the photosensitive drum 4 than the locking member 27 is to the photosensitive drum 4 in the front-rear direction. That is, the pressing member 26R is arranged between the locking member 27 and the photosensitive drum 4. Further, the distance between the pressing member 26L and the photosensitive drum 4 is equal to the distance between the pressing member 26R and the photosensitive drum 4.

In other words, the distance (shortest distance) between "the contact position C at which the pressing member 26L of the drum cartridge 2 and the pressing protrusion 60L of the developing cartridge 3 are in contact with each other" and "the rotation axis A1 of the photosensitive drum 4" (or, the distance L1) is shorter than a distance (shortest distance) between "a position at which the locking member 27 of the drum cartridge 2 and the engagement protrusion 64 of the developing cartridge 3 engage each other" and "the rotation axis A1 of the photosensitive drum 4". Further, the distance (shortest distance) between "the contact position at which the pressing protrusion 60R of the developing cartridge 3 and the pressing member 26R of the drum cartridge 2 are in contact with each other" and "the rotation axis A1 of the photosensitive drum 4" is shorter than the distance (shortest distance) between "the position at which the locking member 27 of the drum cartridge 2 and the engagement protrusion 64 of the developing cartridge 3 engage each other" and "the rotation axis A1 of the photosensitive drum 4".

Accordingly, even if front end portions of the side wall 24L and the side wall 24R are not connected to each other, that is, even if the drum cartridge 2 is not provided with a front wall, the developing cartridge 3 can be stably pressed toward the photosensitive drum 4 by the pressing member 26L and the pressing member 26R that are positioned closer to the photosensitive drum 4 than the locking member 27 is to the photosensitive drum 4.

Thus, even if the size of the developing cartridge 3 is made larger in a frontward direction (in a direction away from the photosensitive drum 4) in order to increase the amount of toner to be stored in the toner storage portion 10, the developing roller 7 can be stably pressed against the photosensitive drum 4.

Further, a space frontward of the pressing member 26R can be efficiently utilized for arranging the locking member 27.

(2) According to the process cartridge 1 and the drum cartridge 2 of the embodiment, as illustrated in FIG. 11, the distance L1 between the contact position C (at which the pressing member 26L and pressing protrusion 60L are in contact with each other) and the rotation axis A1 of the photosensitive drum 4 is shorter than the distance L2 between the rotation axis A3 of the agitator 11 and the rotation axis A1 of the photosensitive drum 4.

That is, the developing cartridge 3 (pressing protrusion 60L) can be pressed toward the photosensitive drum 4 at a position closer to the photosensitive drum 4 than the agitator shaft 11A is to the photosensitive drum 4.

As a result, the developing roller 7 can be more stably pressed against the photosensitive drum 4.

(3) According to the process cartridge 1 and the drum cartridge 2 of the embodiment, as illustrated in FIGS. 13 and 14, the pressing member 26L and the pressing member 26R can move linearly in the front-rear direction (toward and away from the photosensitive drum 4).

Hence, the developing cartridge 3 can be reliably pressed toward the photosensitive drum 4. As a result, the developing roller 7 can be more stably pressed against the photosensitive drum 4.

(4) In the process cartridge 1 and the drum cartridge 2 of the embodiment, as illustrated in FIG. 6, the pressing protrusion 60R protrudes rightward from the side wall 53R. Thus, the pressing protrusion 60R can be easily accessed from its right side.

Further, as illustrated in FIG. 8, the pressing protrusion 60L protrudes leftward from the side wall 53L.

Thus, the pressing protrusion 60L can be easily accessed from its left side.

(5) In the process cartridge 1 and the drum cartridge 2 according to the embodiment, as illustrated in FIG. 6, the engagement protrusion 64 configured to engage the locking member 27 protrudes rightward from the side wall 53R.

Hence, the locking member 27 can be easily brought into engagement with the engagement protrusion 64 from the right side.

(6) In the process cartridge 1 and the drum cartridge 2 of the embodiment, as illustrated in FIGS. 2 and 3, the locking member 27 can be reliably maintained at the restricting position by the urging force of the tension spring 47.

Hence, the developing cartridge 3 can be reliably restricted from getting detached from the drum cartridge 2.

(7) According to the process cartridge 1 and the drum cartridge 2, as illustrated in FIG. 10, the locking member 27 is disposed between the side wall 53R of the developing frame 51 and the side wall 24R of the drum frame 21.

The locking member 27 can be reliably arranged in a space available between the side wall 53R of the developing frame 51 and the side wall 24R of the drum frame 21.

(8) According to the process cartridge 1 and the drum cartridge 2 of the embodiment, as illustrated in FIG. 2, the locking member 27 is disposed between the wall portion 35 and the side wall 24R of the drum frame 21.

Hence, the locking member 27 can be reliably supported so as to be sandwiched between the wall portion 35 and the side wall 24R of the drum frame 21.

(9) According to the process cartridge 1 and the drum cartridge 2 of the embodiment, as illustrated in FIGS. 1 and 2, the locking member 27 is disposed between the developing roller 7 and the rollers 28 with which the developing cartridge 3 is brought into contact from above.

Hence, as illustrated in FIG. 11, the pressing member 26L and the pressing member 26R can press the developing cartridge 3 toward the photosensitive drum 4, while positioning of the developing cartridge 3 relative to the drum cartridge 2 in the up-down direction can be realized by bringing the developing cartridge 3 into abutment contact with the rollers 28.

The developing cartridge 3 can therefore be more reliably pressed toward the photosensitive drum 4.

Further, at this time, as shown in FIG. 12, the locking member 27 can reliably restrict detachment of the developing cartridge 3 from the drum cartridge 2.

(10) According to the process cartridge 1 and the drum cartridge 2 of the embodiment, as illustrated in FIG. 4, the pressing member 26L is disposed between the left roller 28 and the photosensitive drum 4. The pressing member 26R is disposed between the right roller 28 and the photosensitive drum 4.

The rollers 28 can be brought into contact with the developing cartridge 3 at positions farther away from the developing roller 7 than the pressing member 26L and the pressing member 26R are from the developing roller 7.

With this structure, positioning of the developing cartridge 3 in the up-down direction can be realized at a position farther away from the developing roller 7 than otherwise.

As a result, the developing cartridge 3 can be more stably pressed toward the photosensitive drum 4.

(11) In the process cartridge 1 and the drum cartridge 2 of the embodiment, as illustrated in FIG. 2, the rollers 28 are disposed on the front end portion of the drum cartridge 2.

The rollers 28 can be brought into contact with the developing cartridge 3 at positions farthest away from the developing roller 7.

As a result, the developing cartridge 3 can be more stably pressed toward the photosensitive drum 4.

(12) In the process cartridge 1 and the drum cartridge 2 of the embodiment, as illustrated in FIG. 1, the front wall 55 of the developing frame 51 is positioned beyond the drum frame 21 in the front-rear direction to be positioned frontward of the drum frame 21.

The developing cartridge 3 can be made lager in size such that the front end portion of the developing cartridge 3 can enlarged frontward to extend beyond the drum frame 21.

7. Variations and Modifications (1) In the above-described embodiment, only one agitator 11 is provided inside the toner storage portion 10. However, if the capacity of the toner storage portion 10 is to be increased, a plurality of the agitators 11 may be provided inside the toner storage portion 10.

In this case, the distance L1 between the contact position C (at which the pressing protrusion 60L and the pressing member 26L are in contact with each other) and the rotation axis A1 of the photosensitive drum 4 may be shorter than a distance defined between the rotation axis A3 of one of the agitators 11 positioned closest to the photosensitive drum 4 and the rotation axis A1 of the photosensitive drum 4.

According to the structure of this modification, the pressing member 26L and pressing member 26R can press the developing cartridge 3 at positions closer to the photosensitive drum 4 than the agitator shaft 11A of the agitator 11 positioned closest to the photosensitive drum 4 among the plurality of agitators 11 is to the photosensitive drum 4.

As a result, the developing roller 7 can be more stably pressed against the photosensitive drum 4.

(2) In the depicted embodiment, the developing cartridge 3 is mounted in and removed from the main body 82 of the image forming apparatus 81 in a state where the developing cartridge 3 is attached to the drum cartridge 2. However, alternatively, the developing cartridge 3 may be configured to be attached to and detached from the drum cartridge 2 that has already been mounted in the main body 82 of the image forming apparatus 81.

(3) In the above-described embodiment, the rollers 28 serve as an example of a contact part. However, instead of the rollers 28, a spherical protrusion protruding upward from the lower wall 25 of the drum cartridge 2 may serve as the contact part.

(4) Further, instead of the tension spring 47, a rubber band, for example, may be used as an example of an urging member.

While the description has been made in detail with reference to specific embodiments thereof, it would be apparent to those skilled in the art that various changes and modifications may be made therein without departing from the scope of the above described embodiments.

What is claimed is:

1. A process cartridge comprising:

a drum cartridge; and a developing cartridge attachable to and detachable from the drum cartridge, the developing cartridge comprising a developing roller, a pressing protrusion and an engagement protrusion, the drum cartridge comprising:

a photosensitive drum;

a locking member engageable with the engagement protrusion of the developing cartridge attached to the drum cartridge, the locking member being pivotable between a restricting position engaged with the engagement protrusion to restrict detachment of the developing cartridge from the drum cartridge and a non-restricting position disengaged from the engagement protrusion to allow detachment of the developing cartridge from the drum cartridge; and a pressing member disposed between the locking member and the photosensitive drum, the pressing member being configured to contact the pressing protrusion of the developing cartridge attached to the drum cartridge for pressing the developing cartridge toward the photosensitive drum.

2. The process cartridge as claimed in claim 1, wherein the pressing member is configured to move linearly toward and away from the photosensitive drum.

3. The process cartridge as claimed in claim 1, wherein the drum cartridge further comprises a compression spring positioned between the locking member and the pressing member, the compression spring being configured to press the pressing member toward the photosensitive drum.

4. The process cartridge as claimed in claim 3, wherein the locking member comprises: a shaft having a peripheral surface; and a restricting part extending from the peripheral surface of the shaft, the restricting part being configured to engage the engagement protrusion of the developing cartridge attached to the drum cartridge.

5. The process cartridge as claimed in claim 4, wherein the restricting part comprises a claw extending toward the photosensitive drum.

6. The process cartridge as claimed in claim 1, wherein the drum cartridge further comprises an urging member configured to urge the locking member toward the restricting position.

7. The process cartridge as claimed in claim 6, wherein the urging member is a spring.

8. The process cartridge as claimed in claim 6, wherein the urging member is a tension spring.

9. The process cartridge as claimed in claim 1, wherein the drum cartridge further comprises a roller configured to make abutment contact with the developing cartridge attached to the drum cartridge, the locking member being positioned between the roller and the photosensitive drum.

10. The process cartridge as claimed in claim 1, wherein the developing cartridge further comprises an agitator configured to convey toner toward the developing roller, the agitator including an agitator shaft, and wherein the pressing protrusion is positioned between the agitator shaft and the photosensitive drum.

11. A drum cartridge to which a developing cartridge including a developing roller is detachably attachable, the drum cartridge comprising:

a photosensitive drum;

a locking member configured to pivot between a restricting position engaged with the developing cartridge to restrict detachment of the developing cartridge and a non-restricting position disengaged from the developing cartridge to allow detachment of the developing cartridge; and a pressing member disposed between the locking member and the photosensitive drum, the pressing member being configured to press the developing roller toward the photosensitive drum when the developing cartridge is attached to the drum cartridge.

12. The drum cartridge as claimed in claim 11, wherein the pressing member is configured to move linearly toward and away from the photosensitive drum.

13. The drum cartridge as claimed in claim 11, further comprising a compression spring positioned between the locking member and the pressing member, the compression spring being configured to press the pressing member toward the photosensitive drum.

14. The drum cartridge as claimed in claim 11, wherein the locking member comprises: a shaft having a peripheral surface; and a restricting part extending from the peripheral surface of the shaft, the restricting part being engageable with the developing cartridge attached to the drum cartridge.

15. The drum cartridge as claimed in claim 14, wherein the restricting part comprises a claw extending toward the photosensitive drum.

16. The drum cartridge as claimed in claim 11, further comprising an urging member configured to urge the locking member toward the restricting position.

17. The drum cartridge as claimed in claim 16, wherein the urging member is a spring.

18. The drum cartridge as claimed in claim 16, wherein the urging member is a tension spring.

19. The drum cartridge as claimed in claim 11, further comprising a roller configured to make abutment contact with the developing cartridge attached to the drum cartridge, the locking member being positioned between the roller and the photosensitive drum.

20. A drum cartridge comprising:

a photosensitive drum;

a locking lever configured to pivotally move, the locking lever comprising:

a shaft having a peripheral surface; and an operation arm extending from the peripheral surface of the shaft, the operation arm including a base and a claw extending from the base toward the photosensitive drum; and a spring disposed between the locking lever and the photosensitive drum.

21. The drum cartridge as claimed in claim 20, wherein the spring is a compression spring and is compressed in a compressed direction, the compression spring having one end and another end in the compressed direction, and wherein the one end of the compression spring is arranged closer to the photosensitive drum than the another end is to the photosensitive drum.

22. The drum cartridge as claimed in claim 21, further comprising:

a pressing member provided on the one end of the compression spring; and a guide configured to guide the pressing member to move in the compressed direction.

23. The drum cartridge as claimed in claim 22, wherein the pressing member includes a first surface opposing the photosensitive drum and a second surface extending from the first surface in a direction away from the photosensitive drum, the first surface and the second surface defining an angle therebetween.

24. The drum cartridge as claimed in claim 20, wherein the locking lever is pivotally movable between a first position and a second position, the claw being positioned closer to the photosensitive drum when the locking lever is at the second position than at the first position.

25. The drum cartridge as claimed in claim 24, further comprising another spring configured to urge the locking lever to pivotally move the locking lever toward the second position from the first position.

26. The drum cartridge as claimed in claim 25, further comprising a pressing member provided on one end of the spring, wherein the locking lever at the second position is disposed spaced away from the pressing member.

27. The drum cartridge as claimed in claim 20, wherein the locking lever further comprises a lift arm extending from the peripheral surface of the shaft, the lift arm and the operation arm extending in directions opposite to each other.

* * * * *